US008485604B2

(12) United States Patent
Pfeifer et al.

(10) Patent No.: US 8,485,604 B2
(45) Date of Patent: Jul. 16, 2013

(54) SEAT ASSEMBLY WITH AN ELASTOMER TORSION-SPRING ELEMENT

(75) Inventors: Stephan Pfeifer, Koblenz (CH); Wolfgang Emmenegger, Küssaberg-Dangstetten (DE)

(73) Assignee: Stoll Giroflex AG, Koblenz (CH)

( * ) Notice: Subject to any disclaimer, the term of this patent is extended or adjusted under 35 U.S.C. 154(b) by 35 days.

(21) Appl. No.: 13/006,826

(22) Filed: Jan. 14, 2011

(65) Prior Publication Data

US 2011/0181085 A1 Jul. 28, 2011

(30) Foreign Application Priority Data

Jan. 22, 2010 (EP) ..... 10405013
Oct. 22, 2010 (EP) ..... 10013971

(51) Int. Cl.
*A47C 1/024* (2006.01)
*A47C 1/032* (2006.01)
*A47C 3/025* (2006.01)
*A47C 3/026* (2006.01)

(52) U.S. Cl.
USPC ..... 297/300.4; 297/301.3

(58) Field of Classification Search
USPC ..... 297/300.4, 301.3
See application file for complete search history.

(56) References Cited

U.S. PATENT DOCUMENTS 1,906,057 A 4/1933 Guy
3,881,772 A * 5/1975 Mohrman ..... 297/300.4
4,101,166 A * 7/1978 Rauschenberg et al. ... 297/301.3
4,586,748 A * 5/1986 Dingler et al. ..... 297/300.4
4,732,424 A * 3/1988 Uredat-Neuhoff ..... 297/300.4 X
4,768,761 A 9/1988 Kramer (Continued)

FOREIGN PATENT DOCUMENTS

CH 681772 A5 5/1993
DE 11 28 307 B 4/1962

(Continued)

OTHER PUBLICATIONS

European Search Report in EP Appln. No. EP 10405013.3, dated Jun. 29, 2010.

*Primary Examiner* — Rodney B White
(74) *Attorney, Agent, or Firm* — Venable LLP; Jeffri A. Kaminski

(57) ABSTRACT

A seat assembly including a seat base, a back support, a support for the back support and/or for the seat base and at least one elastomer torsion-spring element. The back support and/or the seat base are/is pivotably hinged to the support in such a manner that a pivoting movement of the back support and/or of the seat base on a rotation axis can be carried out. During the respective pivoting movement of the back support and/or of the seat base with the elastomer torsion-spring element a restoring torque is generated that acts on the back support and/or on the seat base. The elastomer torsion-spring element includes an internal casing, an external casing encompassing the internal casing, and an elastomer body arranged in a space between the internal casing and the external casing. The elastomer body is rigidly connected to contact surfaces of the internal and external casings. The internal casing and/or the external casing are/is rotatably arranged on a rotation axis. During rotation of the internal casing and/or of the external casing on the rotation axis deformation of the elastomer body occurs. The contact surface of the internal or external casings include a non-circular cross section in a sectional plane perpendicular to the rotation axis.

40 Claims, 18 Drawing Sheets

U.S. PATENT DOCUMENTS

| | | | | |
|---|---|---|---|---|
| 6,386,634 | B1 * | 5/2002 | Stumpf et al. | 297/300.4 |
| 6,585,320 | B2 * | 7/2003 | Holbrook et al. | 297/300.4 |
| 7,097,249 | B2 * | 8/2006 | Igarashi et al. | 297/300.4 X |
| 2002/0190555 | A1 * | 12/2002 | Holbrook et al. | 297/300.4 |
| 2003/0034681 | A1 * | 2/2003 | Stumpf et al. | 297/300.4 X |
| 2005/0146185 | A1 * | 7/2005 | Fookes et al. | 297/300.4 |
| 2006/0071523 | A1 * | 4/2006 | Stumpf et al. | 297/300.4 |
| 2010/0109402 | A1 * | 5/2010 | Masunaga | 297/300.4 |

FOREIGN PATENT DOCUMENTS

| | | | |
|---|---|---|---|
| DE | 15 54 058 | A1 | 3/1970 |
| EP | 1486142 | | 12/2004 |
| GB | 2 070 727 | | 9/1981 |
| GB | 2 166 215 | A | 4/1986 |
| WO | WO 93/03653 | | 3/1993 |

* cited by examiner

SEAT ASSEMBLY WITH AN ELASTOMER TORSION-SPRING ELEMENT

CROSS-REFERENCE TO RELATED APPLICATIONS

This application claims the priority benefit of European Patent Application Nos. EP 10405013 and EP 10013971, filed on Jan. 22, 2010, and Oct. 22, 2010, respectively, each of which is hereby incorporated by reference in its entirety.

BACKGROUND

1. Field of Invention

The invention relates to a seat assembly with a seat base, with a back support and with a support for the back support and/or the seat base, wherein the back support and/or the seat base are/is pivotably arranged on the support in such a manner that a pivoting movement of the back support and/or of the seat base on a rotation axis can be carried out, and wherein the seat assembly comprises at least one elastomer torsion-spring element for transmitting a force between the back support and the support and/or for transmitting a force between the seat base and the support.

2. Related Art

For example, elastomer torsion-spring elements are known which comprise an internal casing, an external casing that encompasses the internal casing and an elastomer body arranged in a space between the internal casing and the external casing. In this arrangement the internal casing as a rule comprises at least one contact surface at which the elastomer body is in contact with the internal casing, while the external casing comprises at least one contact surface at which the elastomer body is in contact with the external casing. Furthermore, the internal casing and/or the external casing of the respective elastomer torsion-spring element are/is rotationally arranged on a rotation axis, and rotation of the internal casing and/or of the external casing by a rotation angle on the rotation axis can be carried out in such a manner that during the respective rotation the internal casing is moved relative to the external casing, and in this process deformation of the elastomer body is generated so that the elastomer body generates a restoring torque between the external casing and the internal casing, which restoring torque acts against the rotation.

Such an elastomer torsion-spring element is, for example, used in devices for transmitting power between bodies that can be moved relative to each other in order to, during movement of a first body relative to a second body, generate a restoring force that counteracts the respective movement. If a first force acts on the first body and consequently moves the first body relative to the second body, the respective device for transmitting power causes, for example, the device for transmitting power to generate a restoring force that counteracts the first force so that the first body can assume an equilibrium position relative to the second body, wherein in the equilibrium position the first force is compensated for by the respective restoring force.

Such a device for transmitting power between a first body and a second body which is movable relative to the first body can be implemented with the use of at least one elastomer torsion-spring element of the type mentioned above, and with the use of a first coupling means for coupling the first body to the external casing of the respective elastomer torsion-spring element and a second coupling means for coupling the second body to the internal casing of the respective elastomer torsion-spring element. For this purpose the first coupling means and the second coupling means can, for example, be designed in such a manner that the first body can be coupled to the external casing of the respective elastomer torsion-spring element in such a manner and the second body can be coupled to the internal casing of the respective elastomer torsion-spring element in such a manner that during movement of the first body relative to the second body rotation of the internal casing and/or of the external casing by a rotation angle on the rotation axis is carried out, in which rotation the internal casing is moved relative to the external casing and in this process deformation of the elastomer body is generated. In this arrangement the elastomer body of the respective elastomer torsion-spring element generates a restoring torque between the respective external casing and the respective internal casing, which restoring torque acts against the rotation of the internal casing or of the external casing. In this arrangement the restoring torque generated by the respective elastomer torsion-spring element corresponds to a restoring force that counteracts the respective movement of the first body relative to the second body.

Devices for the transmission of power according to the type mentioned above are used in many technical applications in the field of machine construction.

One field of application of such devices for transmitting power relates, among other things, to seat assemblies, for example chairs.

Seat assemblies are frequently designed so as not to be rigid; instead they usually comprise a support structure arranged in a fixed manner, and a back piece that can be pivoted relative to the support structure and/or a seat base that can be pivoted relative to the support structure, in order to make it possible, for example, on the one hand to adapt the spatial arrangement of the back piece and/or of the seat base to the respective body posture of a person seated on the respective seat assembly, which person continually varies their body posture, or, for example, to make it possible for the same seat assembly to be adapted to different requirements of different persons, for example of different body size or different body weight or different habits relating to their preferred body posture. In this case a device for transmitting power of the type mentioned above can advantageously be used to couple the back piece by way of the respective elastomer torsion-spring element to the support structure, and thus to make it possible, if a force acts on the back piece, for said back piece to be pivoted relative to a predetermined normal position and the respective elastomer torsion-spring element during the respective pivoting movement of the back piece to generate a restoring force that acts on the back piece or generates a restoring torque that acts on the back piece in order to in each case hold the back piece in a stable equilibrium position. The latter improves seating comfort. Correspondingly, a device for transmitting power of the type mentioned above can be used to couple a seat base of the seat assembly by way of the respective elastomer torsion-spring element to the support structure.

EP 1486142 A1 shows a chair comprising an elastomer-elastomer torsion-spring element 258 of the type mentioned above, which element is used to generate a restoring torque that counteracts a pivoting movement of a seat support on a rotation axis. The elastomer torsion-spring element 258 comprises an internal casing 260 and an external casing 264, wherein in a space between the internal casing 260 and the external casing 264 an elastomer body 262 has been incorporated. The internal casing 260 on its exterior comprises a contact surface at which the elastomer body 262 is in contact with the internal casing 260, and the external casing 264 on its interior comprises a contact surface at which the elastomer body 262 is in contact with the external casing 264. In this arrangement the elastomer body 262 is rigidly connected to the respective contact surface of the internal casing 260 and to the respective contact surface of the external casing 264 so that the elastomer body 262 cannot slip relative to the internal casing or to the external casing either on the contact surface of the internal casing 260 or on the contact surface of the external casing 264.

The external casing 264 and the internal casing 260 are designed so as to be cylindrical and are arranged coaxially relative to each other. The external casing 264 is held to a support structure of the chair, while the internal casing 260 is seated in a rotationally fixed manner on a shaft 250 that is rotatable on its longitudinal axis. A seat base 32 of the chair is coupled to the shaft 250 in such a manner that if the weight of a person acts on the seat base 32 the shaft 250 is rotated on its longitudinal axis and the seat base 32 is pivoted from a predefined normal position. As a result of rotation of the shaft 250 the internal casing 260 is rotated on its longitudinal direction and in this process is rotated relative to the external casing 264, and consequently the elastomer torsion-spring element 258 generates a restoring torque that acts on the shaft 250 or on the seat base 32, which restoring torque counteracts the rotation movement of the shaft 250 or the pivoting movement of the seat base 32 and increases as the rotation angle increases. In the case of the elastomer torsion-spring element 258 the extent of the minimum torque acting on the shaft 250 when the seat base 32 is pivoted from the above-mentioned normal position (hereinafter referred to as the "minimum restoring torque") can be changed, for example depending on the body weight of the person seated on the chair. For this purpose the external casing 264 can be rotated on its longitudinal axis by means of a rotary mechanism that is arranged on the support structure of the chair, and can thus be rotated on the longitudinal axis of the shaft 250, wherein the external casing 264 is rotated relative to the support structure of the chair and relative to the internal casing 260 or to the shaft 250. By means of rotating the external casing 264 relative to the internal casing 260 the elastomer torsion-spring element 258 is pre-tensioned, wherein the rotation angle by which the external casing 264 is rotated relative to the internal casing 260 when the seat base 32 is in the normal position determines the extent of the "minimum restoring torque".

Due to the cylindrical shape of the external casing 264 and of the internal casing 260 the contact surfaces of the external casing 264 and of the internal casing 260, which contact surfaces in each case adjoin the elastomer body 262, are circular, in each case in a sectional plane that is perpendicular to the shaft 250. During rotation of the shaft 250 on its longitudinal direction the elastomer body 262 is deformed in such a manner that it is subjected to tensile loads.

The elastomer torsion-spring element 258 is associated with a disadvantage in that the restoring torque that is generated during rotation of the shaft 250 by a certain rotation angle shows a relatively slight rise as a function of the respective rotation angle, in particular in those cases where the elastomer torsion-spring element 258 is not pre-tensioned or is only slightly pre-tensioned. This leads to a further disadvantage in that the elastomer torsion-spring element 258 needs to be pre-tensioned to a very high extent if a large minimum restoring torque is to be set, for example in order to provide appropriate seating comfort to a person of substantial body weight. Furthermore, the restoring torque as a function of the rotation angle of the shaft 250 increases in a strongly nonlinear (progressive) manner if the shaft 250 is, for example, to be rotated by a rotation angle ranging from 0 to approx. 70°. In the context of applications relating to seat assemblies, substantial nonlinearity of the restoring torque in the above-mentioned rotary angle range is undesirable because such nonlinearities are, as a rule, perceived by users to be disagreeable. Thus the available rotary angle range is reduced, which is uncomfortable. In addition, as a result of the substantial pre-tension the elastomer body 262 is permanently exposed to considerable load, and consequently experiences fatigue earlier. Consequently, the elastomer torsion-spring element 258 has a short service life and needs to be frequently replaced. There is a further disadvantage in that setting the respective pre-tension of the elastomer torsion-spring element 258 is cumbersome and time consuming, all the more so since the external casing 264 needs to be adjusted by a large angle relative to the internal casing 260 for a minimum restoring torque to be set.

From GB 2070727 A a further elastomer torsion-spring element of the type mentioned above is known. This elastomer torsion-spring element is used in a device for transmitting power between a base plate and a motor that is held so as to be movable relative to the base plate. This elastomer torsion-spring element also comprises an internal casing and an external casing that encompasses the internal casing, wherein the internal casing and/or the external casing are/is rotatably arranged on a rotation axis. The external surface of the internal casing and the internal surface of the external casing comprise a cross section in the form of a square in a sectional plane that is perpendicular relative to the rotation axis. There is a space between the internal casing and the external casing. In the "normal position" the internal casing of the elastomer torsion-spring element is rotated by 45° on the rotation axis relative to the external casing so that in this case the space essentially comprises four subregions formed in the region of the four corners of the external casing and which have the shape of a triangle when viewed in a cross section perpendicular to the rotation axis. In each of these four subregions in each case an elastomer body (preferably comprising rubber) is inserted. In its non-deformed state the respective elastomer body has a cylindrical shape. Prior to placement in the respective subregions of the space, the elastomer bodies are in each case compressed and in the compressed state are inserted in the respective subregion of the space in such a manner that each of the subregions is essentially taken up by one of the elastomer bodies, and each of the elastomer bodies rests at a certain pressure against the external surface of the internal casing and against the internal surface of the external casing, wherein the elastomer body is not rigidly connected either to the internal casing or to the external casing. In each case the four elastomer bodies of this elastomer torsion-spring element are identical so that the internal casing of the elastomer torsion-spring element is held in the above-mentioned normal position by the elastomer bodies, provided no external forces act on the external casing or on the internal casing, which external forces could rotate the internal casing relative to the external casing on the rotation axis. However, if the internal casing is rotated on the rotation axis relative to the external casing, then the four elastomer bodies generate a restoring torque between the internal casing and the external casing, which restoring torque counteracts the respective rotation movement and increases as the rotation angle increases. This elastomer torsion-spring element is associated with various disadvantages. The internal casing can at most be rotated on the rotation axis by approx. 30° relative to the external casing, namely to the same extent in both directions of rotation. Rotating movements by more than 30° when compared to the normal position are not practicable. During rotation of the internal casing the restoring torque of this elastomer torsion-spring element increases by a rotation angle (relative to the above-mentioned normal position in relation to the external casing) as a function of the rotation angle in a range from 0 to 30° with substantial nonlinearity. Furthermore, when the internal casing is rotated by more than 30° relative to the internal casing or to the external casing there is a danger of the elastomer bodies slipping. In this arrangement the internal casing can move to an unstable position so that the elastomer bodies are no longer able to generate a restoring torque that can reliably move the internal casing back to the respective normal position relative to the external casing. In many applications such instability is undesirable and may need to be prevented, for example with the use of safety measures that block further rotation of the internal casing when rotating the internal casing relative to the normal position attains a critical limit of approx. 30° relative to the normal position.

SUMMARY

It is thus an object of the present invention to avoid the above-mentioned disadvantages and to create a seat assembly with an elastomer torsion-spring element that makes it possible to rotate the internal casing relative to the external casing by more than 30° and that generates a restoring torque that shows a relatively steep rise as a function of the respective rotation angle, and in as wide a rotary angle range as possible shows an essentially linear progression as a function of the rotation angle.

According to an embodiment of the invention, the respective seat assembly comprises a seat base, a back support, a support for the back support and/or for the seat base, wherein the back support and/or the seat base are/is pivotably hinged to the support in such a manner that a pivoting movement of the back support and/or of the seat base on a rotation axis (6) can be carried out. The respective seat assembly furthermore comprises at least one elastomer torsion-spring element.

The respective elastomer torsion-spring element comprises an internal casing, an external casing that encompasses the internal casing, and an elastomer body arranged in a space between the internal casing and the external casing. The internal casing comprises at least one contact surface at which the elastomer body is in contact with the internal casing, and the external casing comprises at least one contact surface at which the elastomer body is in contact with the external casing, wherein the elastomer body is rigidly connected to the contact surface of the internal casing and to the contact surface of the external casing. Furthermore, the internal casing and/or the external casing of the respective elastomer torsion-spring element are/is rotatably arranged on the rotation axis.

According to an embodiment defining a first variant, the support is coupled to the external casing of the respective elastomer torsion-spring element, and the back support and/or the seat base are/is coupled to the internal casing of the respective elastomer torsion-spring element in such a manner that during the respective pivoting movement of the back support (44) and/or of the seat base (5) rotation of the internal casing by a rotation angle on the rotation axis is carried out, during which rotation the internal casing is moved relative to the external casing, and in this process deformation of the elastomer body is generated so that the elastomer body generates a restoring torque between the external casing and the internal casing, which restoring torque acts against the rotation.

In another embodiment defining a second variant (i.e. in an alternative to the above-mentioned first variant), the support is coupled to the internal casing of the respective elastomer torsion-spring element, and the back support and/or the seat base are/is coupled to the external casing of the respective elastomer torsion-spring element in such a manner that during the respective pivoting movement of the back support (44) and/or of the seat base (5) rotation of the external casing by a rotation angle on the rotation axis is carried out, during which rotation the internal casing is moved relative to the external casing, and in this process deformation of the elastomer body is generated so that the elastomer body generates a restoring torque between the external casing and the internal casing, which restoring torque acts against the rotation.

According to another embodiment of the invention, the respective contact surfaces of the internal casing and/or of the external casing are designed in such a manner that in a sectional plane that is perpendicular to the rotation axis the contact surface of the internal casing comprises a non-circular cross section, and/or in a sectional plane that is perpendicular to the rotation axis the contact surface of the external casing comprises a non-circular cross section.

The elastomer body can, for example, be made of rubber.

According to another embodiment of the invention, this elastomer torsion-spring element essentially differs from the above-mentioned elastomer torsion-spring element, known from EP 1486142 A1, in that the contact surface of the internal casing in a sectional plane that is perpendicular to the rotation axis and/or the contact surface of the external casing in a sectional plane that is perpendicular to the rotation axis are/is not circular, while in the case of the elastomer torsion-spring element known from EP 1486142 A1 the contact surface of the internal casing in a sectional plane that is perpendicular to the rotation axis and/or the contact surface of the external casing in each case comprise cross sections in the shape of two concentric circles. In the case of the elastomer torsion-spring element known from EP 1486142 A1 the contact surfaces of the internal casing and of the external casing are consequently designed so as to be rotationally symmetrical relative to the rotation axis of the elastomer torsion-spring element. Among other things this results in the elastomer body of this elastomer torsion-spring element during rotation of the internal casing relative to the external casing being exclusively subjected to tensile loads and being deformed in such a manner that the spatial distribution of the mechanical tension in the elastomer body is in each case rotationally symmetrical to the rotation axis of the elastomer torsion-spring element. In contrast to this, in the case of the elastomer torsion-spring element according to embodiments of the invention, at least one of the contact surfaces of the internal casing or of the external casing is designed so as not to be rotationally symmetrical to the rotation axis. As a result of this difference the respective elastomer bodies of the elastomer torsion-spring element according to embodiments of the invention and of the elastomer torsion-spring element known from EP 1486142 A1 are deformed in a different manner when the internal casing of the respective elastomer torsion-spring element is rotated on the respective rotation axis relative to the external casing of the respective elastomer torsion-spring element. As a result of the cross-sectional shape of the external casing or of the internal casing the elastomer torsion-spring element according to embodiments of the invention generates a restoring torque which basically (when compared to the elastomer torsion-spring element known from EP 1486142 A1) comprises a steeper rise as a function of the respective rotation angle (in particular in the range of small rotation angles). This comparison presupposes that the elastomer bodies of the respective elastomer torsion-spring elements are made from the same elastomer, for example rubber. Consequently, the elastomer torsion-spring element according to embodiments of the invention is associated with an advantage in that the internal casing needs to be rotated by a smaller rotation angle on the rotation axis relative to the external casing in order to pre-tension the elastomer body in such a manner that the elastomer torsion-spring element generates a predefined minimum restoring torque. In this manner, the elastomer torsion-spring element according to embodiments of the invention provides an advantage in that the elastomer body needs to be extended to a lesser extent, and is consequently less prone to wear and fatigue.

The respective elastomer torsion-spring element of the seat assembly according to embodiments of the invention among other things differs from the above-mentioned elastomer torsion-spring element known from GB 2070727 A in that the elastomer body is rigidly connected to the contact surface of the internal casing and to the contact surface of the external casing. This provides an advantage in that the elastomer body in the region of the above-mentioned contact surfaces cannot slide either relative to the contact surface of the internal casing or relative to the contact surface of the external casing, even if the internal casing is rotated on the rotation axis relative to the external casing, and in this process the elastomer body is deformed. In that the elastomer body is rigidly connected to the internal casing and to the external casing, in the case of the elastomer torsion-spring element according to embodiments of the invention it is possible to insert the elastomer body into the space between the internal casing and the external casing in such a manner that the elastomer body (at least in a specified position of the internal casing relative to the external casing) is not pre-tensioned and in particular is not compressed. This results, in particular when compared to the elastomer torsion-spring element known from GB 2070727 A, in the internal casing (starting from a determined normal position relative to the external casing) being able to be rotated over a rotary angle range exceeding 30°, e.g. by a rotation angle ranging from 0°-80°, relative to the external casing without damaging the elastomer body. Furthermore, the elastomer body can be designed in such a manner that the elastomer torsion-spring element according to embodiments of the invention during a rotation movement of the internal casing relative to the external casing generates a restoring torque which for rotation angles in the range of, for example, 0°-80° shows an essentially linear progression as a function of the rotation angle.

In an improvement of the above-mentioned first variant the external casing of the respective elastomer torsion-spring element is connected to the support, and the internal casing of the respective elastomer torsion-spring element is rotatably connected to a bearing shaft that can be rotated on the rotation axis, which bearing shaft is connected in a rotationally rigid manner to the back support and/or to the seat base.

As an alternative, in an improvement of the above-mentioned second variant, the internal casing of the respective elastomer torsion-spring element is connected to the support, and the external casing of the respective elastomer torsion-spring element is connected to a bearing shaft that can be rotated on the rotation axis, which bearing shaft is connected in a rotationally rigid manner to the back support and/or to the seat base.

Another embodiment of the respective elastomer torsion-spring element of the respective seat assembly according to the invention is characterised in that the contact surface of the internal casing and the contact surface of the external casing are arranged relative to each other in such a manner that during rotation of the internal casing and/or of the external casing on the rotation axis at least in a predetermined rotary angle range a reduction in the distance between a defined point of the internal casing and a defined point of the external casing can be caused. In this case, due to the above-mentioned reduction in the distance between the respective points of the internal casing and of the external casing, during rotation of the internal casing relative to the external casing the elastomer body is not exclusively subjected to tensile loads, but in certain regions of the elastomer body is also subjected to compressive loads. Accordingly the respective deformation of the elastomer body is determined by an overlay of tensile stress and compressive stress. The compressive loads in certain regions of the elastomer body compensate for tensile loads in other regions of the elastomer body. Consequently the entire material of the elastomer body is subjected to loads in a non-homogeneous manner. This embodiment makes it possible to generate a restoring torque between the external casing and the internal casing, which restoring torque shows a particularly steep rise as a function of the respective rotation angle, and in a particularly large rotary angle range shows an essentially linear progression as a function of the rotation angle.

Another embodiment of the respective elastomer torsion-spring element of the respective seat assembly according to the invention is characterised in that the contact surface of the internal casing and the contact surface of the external casing in a sectional plane that is perpendicular to the rotation axis comprise a non-circular cross section and are arranged relative to each other in such a manner that by means of the rotation of the internal casing and/or of the external casing on the rotation axis a compressive load can be caused in at least one region of the elastomer body. In the case of this embodiment, during rotation of the internal casing and/or of the external casing on the rotation axis the elastomer body at least in a certain rotary angle range is deformed in such a manner that the elastomer body in certain regions is subjected to tensile loads, while in other regions it is subjected to compressive loads. In this arrangement tensile loads and compressive loads are distributed within the elastomer body in such a manner that the elastomer body is subjected to loads in a non-homogeneous manner, and the respective compressive stress at least in part compensates for the respective tensile stress. This embodiment makes it possible to generate a restoring torque between the external casing and the internal casing, which restoring torque shows a particularly steep rise as a function of the respective rotation angle, and in a particularly large rotary angle range shows an essentially linear progression as a function of the rotation angle.

In an embodiment of the respective elastomer torsion-spring element of the respective seat assembly according to the invention the contact surface of the internal casing and the contact surface of the external casing are designed in such a manner that the respective rotation of the internal casing and/or of the external casing on the rotation axis by a rotation angle in a predetermined rotary angle range causes a restoring torque that increases in a linear manner with the respective rotation angle. Since the contact surface of the internal casing or the contact surface of the external casing are not rotationally symmetrical relative to the rotation axis, the dependence of the restoring torque on the rotation angle is essentially determined by the position which the internal casing assumes relative to the external casing when the internal casing is in a predefined normal position. The normal position of the internal casing relative to the external casing can be selected in such a manner that the restoring torque as a function of the rotation angle shows a linear progression in the respectively predetermined rotary angle range.

In yet another embodiment of the respective elastomer torsion-spring element of the respective seat assembly according to the invention the contact surface of the internal casing and/or the contact surface of the external casing, in each case in a sectional plane that is perpendicular to the rotation axis, are/is designed so as to be polygonal or at least in some sections to comprise straight lines. Such an embodiment of the contact surfaces of the internal casing and of the external casing makes it possible to provide application-specific non-homogeneous deformation of the elastomer body depending on the respective rotation angle.

In yet another embodiment of the respective elastomer torsion-spring element of the respective seat assembly according to the invention the contact surface of the external casing is designed so as to be cylindrical at least in some sections. Consequently the elastomer body is subjected to loads in a non-homogeneous manner during rotation of the internal casing relative to the external casing.

In still another embodiment of the respective elastomer torsion-spring element of the respective seat assembly according to the invention the contact surface of the external casing, in each case in a sectional plane that is perpendicular to the rotation axis, is designed so as to be rectangular, wherein at least two opposite pairs of corners are rounded. Such an embodiment of the internal surface of the external casing also makes it possible to provide application-specific non-homogeneous loading of the elastomer body depending on the respective rotation angle.

In another embodiment of the respective elastomer torsion-spring element of the respective seat assembly according to the invention the contact surface of the external casing comprises two opposite pairs of equilateral angular segments and two opposite pairs of semicircular segments whose ends in each case are connected to the ends of the rectangular angular segments. With reference to measurement series it has been shown that the elastomer torsion-spring element with a contact surface of the external casing designed in such a manner comprises a characteristic curve in which the progression of the restoring torque is linear in relation to the rotation angle.

In yet another embodiment of the respective elastomer torsion-spring element of the respective seat assembly according to the invention the contact surface of the internal casing, in each case in a sectional plane that is perpendicular relative to the rotation axis, is designed so as to be rectangular. Such an embodiment of the contact surface of the internal casing has been shown to be particularly advantageous, because, as a result of this during rotation of the internal casing relative to the external casing, certain regions of the elastomer body are subjected to compressive forces that compensate for tensile forces in the elastomer body. As a result of this non-homogeneous loading of the elastomer body the restoring torque generated by the elastomer torsion-spring element as a function of the rotation angle in a particularly wide rotary angle range shows a linear progression with a particularly steep rise. For example, the contact surface of the internal casing can be square in a sectional plane that is perpendicular to the rotary axis.

With regard to the shape and size of the external casing and of the internal casing of the respective elastomer torsion-spring element it is advantageous if an internal cross section of the respective external casing and an external cross section of the respective internal casing of the elastomer torsion-spring element are designed in such a manner that the ratio of the surface area of the internal cross section of the respective external casing to the surface area of the external cross section of the respective internal casing is greater than 7/3. This ensures that the restoring torque generated by the respective elastomer torsion-spring element as a function of the rotation angle shows a linear progression in a particularly wide rotary angle range. Provided the above-mentioned conditions are met, for example in the case where the elastomer body of the respective elastomer torsion-spring element is made from rubber, a linear progression of the restoring torque as a function of the rotation angle can be achieved across a rotary angle range of at least 70°.

In the case of the respective elastomer torsion-spring elements it is advantageous if the elastomer body comprises one or several holes that lead through the elastomer body, wherein the respective hole extends along the rotation axis. This measure is associated with several advantages. If, for example, the respective elastomer body has been manufactured by vulcanisation, it is particularly advantageous to form the respective holes in the respective materials already prior to vulcanisation, which materials as a result of vulcanisation form the elastomer body. In this case forming the respective holes has the effect of the respective elastomer body immediately following vulcanisation comprising no elastic tension or only slight elastic tension in the interior so that the respective elastomer torsion-spring element is ready for use immediately following vulcanisation, without there being a need for any subsequent-treatment of the elastomer body. However, if the elastomer body in each case is manufactured without the above-mentioned holes, the elastomer body can comprise relatively high elastic tension in its interior immediately following vulcanisation, even if no torque is applied between the external casing and the internal casing. This elastic tension can lead to a situation in which the respective elastomer torsion-spring element immediately following vulcanisation does not show the in each case desired progression of the restoring torque as a function of the rotation angle. As a rule, in this case the internal casing can be rotated only by a relatively small rotation angle relative to the external casing so that by means of the respective elastomer torsion-spring element immediately following vulcanisation only relatively modest restoring torque could be generated. If the elastomer body of the respective elastomer torsion-spring element following vulcanisation, as described above, comprises relatively high elastic tension in the interior, this elastomer torsion-spring element can, as a rule, be optimised by suitable subsequent treatment that results in a reduction of the respective tension in the interior of the elastomer body, for example by squeezing the respective elastomer body in certain directions. This subsequent treatment is elaborate and thus undesirable. However, it is possible to avoid the need for such subsequent treatment if, as mentioned, prior to vulcanisation one or two holes are made in the respective elastomer body. Such an elastomer body (comprising one or several holes) immediately following vulcanisation comprises no elastic tension or only slight elastic tension; makes possible, without the above-mentioned subsequent treatment, rotation of the internal casing relative to the external casing across a relatively wide rotary angle range; and thus makes it possible to generate relatively high restoring torque.

If the elastomer body of the respective elastomer torsion-spring element comprises one or several through-holes in the elastomer body, this has the effect that the shape and the size of a cross section of the respective hole changes when the internal casing is rotated relative to the external casing by a certain rotation angle and the respective elastomer body is deformed in this process. This effect can be utilised to largely reduce wear of the elastomer body, which can be expected during rotation of the internal casing relative to the external casing at relatively large rotation angles, and in this way the service life of the respective elastomer body can be extended. As already mentioned, in certain regions of the elastomer body the elastomer body of the respective elastomer torsion-spring element of a seat assembly according to embodiments of the invention is also subjected to compressive loads when the internal casing is rotated relative to the external casing by a certain rotation angle. In certain regions of the elastomer body this compressive load causes the elastomer body to locally expand, in the direction of the rotary axis of the elastomer torsion-spring element, in the regions that are subjected to compressive loads, by a certain distance that becomes longer the greater the rotation angle. This expansion of the elastomer body has, for example, the effect that the elastomer body at its surface (in the regions of the elastomer body that are connected neither to the contact surface of the external casing nor to the contact surface of the internal casing) develops deformations in the form of local rises or folds that are all the larger the greater the rotation angle. In the case of large rotation angles it is, for example, possible for adjacent regions of the surface to establish contact with each other as a result of the deformation, so that friction between these regions of the surface arises. For example, because of the above-mentioned friction, such deformations can accelerate wear and tear of the elastomer body, thus shortening the service life of the elastomer body, in particular when the internal casing is rotated frequently and if applicable at high speed relative to the external casing by relatively large rotation angles. Wear and tear of the type mentioned above can be prevented effectively if the elastomer body of the respective elastomer torsion-spring element comprises one or several through-holes in the elastomer body. The respective holes can preferably be arranged in the elastomer body in such a manner that in each case the cross-sectional area of the respective hole decreases as the rotation angle increases. This reduction in the cross-sectional area of the respective hole has the effect that the elastomer body with an increase in the rotation angle in the regions of the elastomer body that are subjected to compressive loads expands to a lesser extent in the direction of the rotation axis of the respective elastomer torsion-spring element so that the surface of the elastomer body is deformed to a lesser extent. Thus the expansion of the elastomer body in the direction of the rotation axis is at least partly compensated for by the reduction in the cross-sectional area of the respective holes. The holes thus improve the loadability of the elastomer body and make it possible to generate relatively large restoring torques without destroying the elastomer body. The respective holes can have a round cross section or a cross section comprising any other shape.

An improvement of the above-mentioned embodiments of the elastomer torsion-spring element comprises a retaining element that is designed (i) to hold the internal casing in a predefined normal position relative to the external casing, in which normal position the elastomer body comprises a predefined elastic deformation and between the external casing and the internal casing generates a restoring torque that equals a predefined minimum value, and (ii) to enable rotation of the internal casing relative to the external casing by a rotation angle on the rotation axis in a direction of rotation in which the restoring torque increases as the rotation angle increases.

In this variant the internal casing, if it is in the normal position, can be rotated only in one direction of rotation on the rotation axis and can thus be rotated relative to the external casing: the retaining element blocks rotation in the other direction of rotation when the internal casing is in the normal position. In the present case the elastomer body always comprises an elastic deformation so that the elastomer torsion-spring element during rotation of the internal casing relative to the external casing generates a restoring torque whose value is always greater than zero. When the internal casing is in the normal position, the restoring torque generated by the elastomer body is taken up by the retaining element. If the internal casing, starting from the normal position, is rotated relative to the external casing, the elastomer body generates a restoring torque between the external casing and the internal casing, which restoring torque steadily increases as the rotation angle increases, namely starting at the above-mentioned minimum value. This minimum value thus defines the minimum restoring torque that can be generated with the elastomer torsion-spring element. The minimum value is determined by the extent of the elastic tension (hereinafter also referred to as "pre-tension of the elastomer body") which the elastomer body comprises when the internal casing is in the normal position relative to the external casing. This minimum value can be set as required. This variant of the elastomer torsion-spring element can advantageously be used in devices for transmitting power between two bodies if in a relative movement between the two bodies a restoring torque is to be generated that always exceeds or equals a minimum value (greater than 0).

The pre-tension of the elastomer body can, for example, be implemented in such a manner that the respective elastomer torsion-spring element is at first manufactured such that the respective elastomer body is rigidly connected in such a manner to the contact surfaces of the respective internal casing and the contact surfaces of the respective external casing, that the elastomer body is at first not deformed and thus does not comprise any mechanical tension when the internal casing is in an initial position relative to the external casing. Subsequently, the internal casing and/or the external casing are/is rotated on the rotation axis in a predetermined direction of rotation by a rotation angle until the rotation angle reaches a predetermined value (hereinafter referred to as the "angular offset relative to the initial position") relative to the initial position, so that the elastomer body is deformed and comprises a predefined mechanical tension. Thereafter, the retaining element can be installed in such a manner that further rotation of the internal casing or of the external casing in the predetermined direction of rotation is possible, while corresponding rotation in the opposite direction is blocked as soon as the respective rotation angle relative to the initial position equals the above-mentioned "angular offset".

The elastomer torsion-spring element according to an embodiment of the invention is associated with an advantage in that the "angular offset" can be selected so as to be relatively small in order to ensure that the restoring torque assumes a determined minimum value (for example when compared to the elastomer torsion-spring element known from EP 1486142 A1). This has a gentle effect on the elastomer body and is thus beneficial with a view to a long service life of the elastomer body.

In another embodiment, the retaining element can be a bar that is arranged on a face of the internal casing so as to be perpendicular to the rotation axis, and, furthermore, is rigidly connected to the internal casing. Moreover, the external casing can comprise a mechanical end stop for the bar, which end stop is arranged in such a manner that during rotation of the internal casing in a determined direction of rotation the bar comes to rest against the end stop so that any further rotation in the same direction of rotation is blocked. In this arrangement, rotation of the internal casing in the opposite direction of rotation is made possible. In this case, the position of the end stop determines the normal position of the internal casing relative to the external casing. The mechanical end stop or the external casing in each case takes up the pre-tension of the elastomer body when the internal casing is in the normal position.

In the predefined normal position the internal casing can be held by the retaining element relative to the external casing, for example, in such a manner that during the respective rotation, made possible by the retaining element, of the internal casing relative to the external casing the restoring torque increases in a linear manner as the rotation angle increases.

In a variant of the above-mentioned embodiment the retaining element comprises at least one tensioning element, which comprises a first section that is firmly engaged in the internal casing, and comprises a second section which when the internal casing is in the predefined normal position relative to the external casing comes to rest against a section of the external casing and enables rotation of the internal casing and of the external casing in relation to each other on the rotation axis in that direction of rotation in which the restoring torque increases. In an alternative to this variant, the retaining element can also comprise at least one tensioning element which comprises a first section that is firmly engaged in the external casing, and comprises a second section which when the internal casing is in the predefined normal position relative to the external casing comes to rest against a section of the internal casing and enables rotation of the internal casing and of the external casing in relation to each other on the rotation axis in that direction of rotation in which the restoring torque increases. In the above-mentioned variants, the tensioning element can in each case be used as a "tool" in order to, by means of a rotation movement of the tensioning element on the rotation axis of the elastomer torsion-spring element, rotate the internal casing relative to the external casing and in this process provide the elastomer body with that mechanical pre-tension that is maintained by means of the retaining element when the internal casing by means of the retaining element is held in the normal position relative to the external casing. This elastomer torsion-spring element is associated with an advantage in that the retaining element can be implemented by simple means: since according to embodiments of the invention the internal casing and/or the external casing comprise/comprises a non-circular cross section, either the external casing or the internal casing can serve as a mechanical end stop for the respective tensioning element, wherein the tensioning element during rotation of the external casing or of the internal casing on the rotation axis in each case follows a circular path on the rotation axis. In order to achieve predefined pre-tension it is merely necessary for the tensioning element to be moved to a suitable position relative to the external casing or to the internal casing.

In one variant of the elastomer torsion-spring element the internal casing comprises a recess, wherein the first section of the tensioning element is inserted in a rotationally rigid manner into this recess in the internal casing, and the second section of the tensioning element, when the internal casing is in the predefined normal position relative to the external casing, comes to rest against a section of the external casing. The latter section of the external casing can, for example, be arranged on an exterior face of the external casing. In this arrangement the angle between the internal casing and the external casing relative to each other is kept offset by a predetermined "angular offset".

The use of the tensioning elements is associated with several advantages. The respective tensioning element requires little in the way of materials and can be manufactured economically. Moreover, installation of the tensioning element on the internal casing and on the external casing of the elastomer torsion-spring element can be carried out in a very simple manner and in a short period of time. Furthermore, no components need to be rigidly connected to the internal casing or to the external casing. Advantageously, several elastomer torsion-spring elements can be pre-tensioned in parallel in a single process step by means of respectively associated tensioning elements, and consequently the time required for installation is still further shortened.

The internal casing and the external casing may be arranged in such a manner relative to each other that the elastomer body with predetermined alignment of the external casing relative to the internal casing comprises pre-tension. It is also possible for several elastomer torsion-spring elements to be arranged parallel to each other, for example fitted onto a bearing shaft. In this arrangement the elastomer torsion-spring elements can comprise different degrees of pre-tension, wherein the respective external casings can nevertheless be aligned so as to be flush with each other.

The respective seat assembly according to an embodiment of the invention can comprise a multitude of the respective elastomer torsion-spring elements, wherein the respective elastomer torsion-spring elements are arranged side by side in such a manner that the internal casings and/or the external casings of the respective elastomer torsion-spring elements are rotatably arranged on the same rotation axis. In this case the totality of all elastomer torsion-spring elements generates a restoring torque that results from the overlay of those restoring torques that are generated by the individual elastomer torsion-spring elements (in each case coupled to the first and to the second body).

The seat assembly can comprise a modular design. The totality of all elastomer torsion-spring elements can, for example, form a module which in each case can be transported or installed as an entity. This simplifies manufacture and maintenance of the seat assembly. The totality of all elastomer torsion-spring elements can, for example, be pre-installed in a module and can subsequently be combined with other components.

In order to combine several elastomer torsion-spring elements to form a module it is possible, for example, to rigidly interconnect the internal casings of the respective elastomer torsion-spring elements and/or to rigidly interconnect the external casings of the respective elastomer torsion-spring elements. For this purpose the respective internal casing can, for example, be placed on a shared bearing shaft and can be affixed to said bearing shaft.

Where appropriate, the elastomer torsion-spring elements of the respective module can comprise different characteristics: the different elastomer torsion-spring elements can, for example, differ in relation to the progression of the restoring torque as a function of the rotation angle. Different elastomer torsion-spring elements can, for example, comprise elastomer bodies that can be differently pre-tensioned so that different elastomer torsion-spring elements can provide different extents of restoring torque when the internal casing of the respective torsion spring element is in the normal position relative to the external casing. By combining different elastomer torsion-spring elements with different characteristics, it is therefore possible, in a simple and cost-effective manner, to manufacture devices for transmitting power, which devices comprise different characteristics as required, or, for example, said devices can be modified in a suitable manner by means of the exchange of individual elastomer torsion-spring elements.

BRIEF DESCRIPTION OF THE DRAWINGS

Further details of the invention, and in particular exemplary embodiments of the seat assembly according to the invention, are explained below with reference to the enclosed drawings. The following are shown.

DETAILED DESCRIPTION

Figure 1:
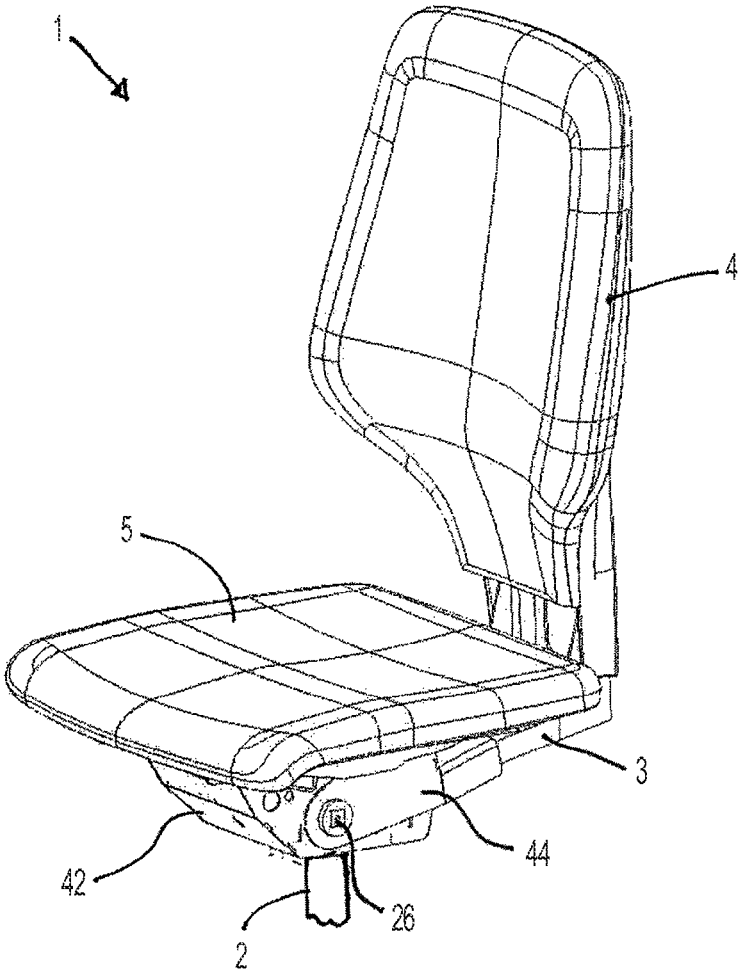
FIG. 1 depicts a seat assembly in the form of a chair according to an embodiment of the invention.

In the respective figures and in the following text in each case identical reference characters are used for identical objects.

FIG. 1 shows an exemplary embodiment of a seat assembly in the form of a chair 1. The chair 1 is a swivelling office chair and is held on a support column 2 by means of which the chair 1 is height-adjustably swivellable by 360°. On the upper end of the support column 2 a support 42 is installed which is aligned so as to be essentially horizontal. The support 42 is used as a casing to receive mechanical elements that will be described below. A back support 44 is pivotably hinged to the support 42 by way of a bearing shaft 26. A back piece 3 is connected to the other end of the back support 44, which back piece is designed to receive a backrest 4 that is arranged so as to be essentially perpendicular. The back piece 3 can be slidable at the connection to the back support 44. Likewise, the backrest 4 can be height-adjustable.

The support 42 comprises a seat support (not shown in the figure) to which a seat base 5 is attached that is arranged so as to be essentially horizontal. The seat support can also be pivotably hinged to the support 42. By means of the pivotable hinging of the back support 44 and of the seat support on the support 42, it is possible for a person seated in the chair 1 with the back piece 4 to recline while, synchronously to the above, the seat support and thus also the seat base 5 can be pivoted. To this effect an elastomer torsion-spring element (not shown) that is arranged in the support 42 applies a restoring torque between the support 42 and the back support 44, wherein the restoring torque is directed in a direction that is opposite to the pivoting direction during pivoting of the back support 44 in relation to the support 42.

Figure 2:
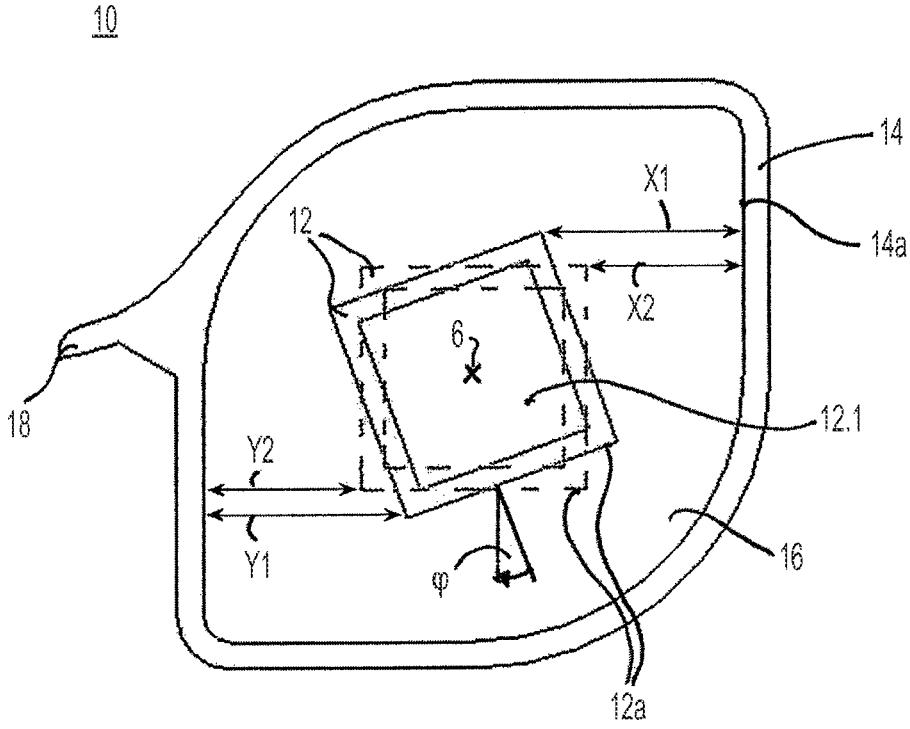
FIG. 2 depicts a diagrammatic lateral view of an elastomer torsion-spring element in a first exemplary embodiment.

FIG. 2 shows a diagrammatic lateral view of the elastomer torsion-spring element 10 according to a first embodiment, wherein according to this view the rotation axis 6 is perpendicular to the drawing plane. The elastomer torsion-spring element 10 comprises an internal casing 12 and an external casing 14. In a space between the internal casing 12 and the external casing 14 an elastomer body 16 is arranged.

On its outside the internal casing 12 comprises a contact surface 12*a* at which the elastomer body 16 is in contact with the internal casing. Furthermore, the external casing 14 on its inside comprises a contact surface 14*a* at which the elastomer body 16 is in contact with the external casing 14. The contact surface 12*a* of the internal casing 12 and the contact surface 14*a* of the external casing 14 in each case encompass the rotation axis 6 in a ring-shaped manner. Correspondingly, in the present example the elastomer body 16 forms a closed ring that encompasses the rotation axis 6.

The elastomer body 16 comprises an elastomer, i.e. a firm and elastically deformable material. The elastomer body 16 is designed in such a manner that it is rigidly connected to the contact surface 12*a* of the internal casing 12 and to the contact surface 14*a* of the external casing 14, i.e. during movement of the internal casing 12 relative to the external casing 14 (e.g. during rotation of the internal casing 12 or of the external casing 14 on the rotation axis 6) there is no sliding of the areas of the elastomer body 16 which adjoin the contact surfaces 12*a* and 14*a* relative to the contact surfaces 12*a* and 14*a*. The elastomer body 16 can, for example, at the contact surfaces 12*a* or 14*a* be connected to the internal casing and to the external casing 14 either integrally or having positive fit.

For example, rubber is an elastomer that is particularly well suited to the manufacture of the elastomer body 16, with rubber not only being an elastically deformable and highly resistant material, but also a material that in a simple manner can be firmly connected to the contact surfaces 12*a* and 14*a*, for example by means of vulcanisation.

The internal casing 12 and the external casing 14 are made from a rigid material such as, for example, steel. The contact surfaces 12*a* and 14*a* of the internal casing 12 or of the external casing 14, which contact surfaces 12*a* and 14*a* in each case adjoin the elastomer body 16, in a sectional plane that is arranged so as to be perpendicular to the rotation axis 6, differ at least in some sections from a circular shape. As a result of this special shape, in some regions of the elastomer body 16, during rotation of the internal casing 12 on the rotation axis 6 in relation to the external casing 14, compressive loads occur which compensate for tensile loads that occur therein. Thus the elastomer body 16 is advantageously subjected to loads in a non-homogeneous manner.

FIG. 2 shows the internal casing 12 in a "non-rotated" state (solid line) and in a "rotated state" (dashed line), wherein the internal casing 12 in the rotated state when compared to the non-rotated state is turned by a rotation angle $\phi$ clockwise on the rotation axis 6, while in this process the position of the external casing 14 remains unchanged. It is assumed that in the case of the non-rotated state the elastomer body 16 is not pre-tensioned, i.e. does not comprise any mechanical tension. In the non-rotated state in each case the distances from the upper right-hand corner or from the lower left-hand corner of the internal casing 12 in each case to defined points on the inside of the external casing 14 are shown by arrows x1 or y1. In the rotated state in each case the distances from the upper right-hand corner or from the lower left-hand corner of the internal casing 12 in each case to defined points on the inside of the external casing 14 are designated by arrows x2 or y2. As shown in FIG. 2, the distance x2 is shorter than x1, and the distance y2 is shorter than y1. In these regions the elastomer body 16 is thus compressed when the internal casing 12 is rotated on the rotation axis 6 and is thus rotated relative to the external casing 14. The above-mentioned compressive loads result from these respective instances of compression.

After rotation of the internal casing 12 by the rotation angle ϕ on the rotation axis 6, the elastomer body 6 is deformed and between the external casing 14 and the internal casing 12 generates a restoring torque D that is directed against the direction of rotation and that increases as the rotation angle ϕ increases.

The fact that the distances x2−x1 and y2−y1 are reduced during rotation of the internal casing 12 by the rotation angle ϕ is due to the cross section of the contact surface 12*a* or of the contact surface 14*a* (in a sectional plane arranged so as to be perpendicular to the rotation axis 6) not being circular. The geometric deviation of the above-mentioned cross sections of the contact surfaces 12*a* or 14*a* from a circle means that during rotation of the internal casing 12 by the rotation angle ϕ a spatial distribution of the mechanical tension in the elastomer body 6 results that is not rotationally symmetrical to the rotation axis 6, in contrast to the spatial distribution of the mechanical tension in an elastomer torsion-spring element according to EP 1486142 A1, which in each case is rotationally symmetrical to the rotation axis 6. This difference in the distribution of tension results in significant differences relating to the dependence of the restoring torque D as a function of the rotation angle ϕ. In particular, these differences result in the elastomer torsion-spring element according to the invention showing a significantly greater increase in the restoring torques D as a function of the rotation angle ϕ when compared to that of the elastomer torsion-spring element according to EP 1486142 A1 (which will be explained in more detail below).

In the embodiment shown in FIG. 2, the contact surface 12*a*, which adjoins the elastomer body 16, of the internal casing 12 is square. In this embodiment the internal casing 12 is designed as a square sleeve (tetrahedron) which comprises a through-channel 12.1 with a square cross section, which through-channel 12.1 extends parallel to the rotation axis 6. This is associated with an advantage in that a square bearing shaft (not shown) with identical dimensions can be radially received in a positive-locking manner in the channel 12.1 of the internal casing 12.

As shown in FIG. 2, in the non-rotated state of the internal casing 12 (solid line) there is a rotational offset between the internal casing 12 and the external casing 14. More precisely expressed, the external surfaces of the internal casing 12 and the (linearly extending) external surfaces of the external casing 14 are not aligned so as to be parallel to each other (rotational offset). The extent of this rotational offset represents a further parameter that has an influence on the progression of the restoring torque D as a function of the rotation angle ϕ.

The external surface of the external casing 14 comprises an external casing cam 18 which can be used to engage a blocking element (not shown in FIG. 2), which will be explained below in the context of FIGS. 5 and 9.

The contact surface 14*a* of the external casing 14, which contact surface 14*a* adjoins the elastomer body 16, has a contour that can be considered a combination of a rectangle and a circle. More precisely expressed, the contour of the external casing 14 comprises two equilateral angular segments, arranged opposite each other in pairs, which angular segments in the present embodiment encompass an angle of 90°, and comprises two semicircular segments, arranged opposite each other in pairs, with the ends of said semicircular segments in each case being connected to the ends of the above-mentioned angular segments. With reference to several measurement series that were carried out it has been established that this contour, which resembles a "lemon shape", of the external casing 14, in combination with the square contour of the internal casing 12, is particularly advantageous in order to create an elastomer torsion-spring element 10 whose characteristic curve of the restoring torque D in relation to the rotation angle ϕ extends in a linear manner in almost all regions of the rotation angle ϕ.

Figure 3:
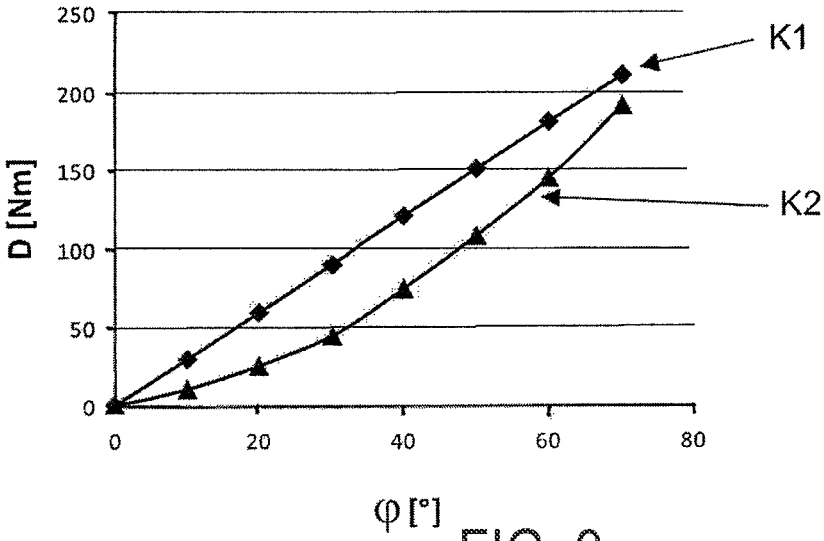
FIG. 3 depicts a diagram with two characteristic curves of restoring torques as a function of the rotation angle for an elastomer torsion-spring element in an exemplary embodiment of the invention (curve K1) and a conventional elastomer torsion-spring element (curve K2)
Figure 3A:
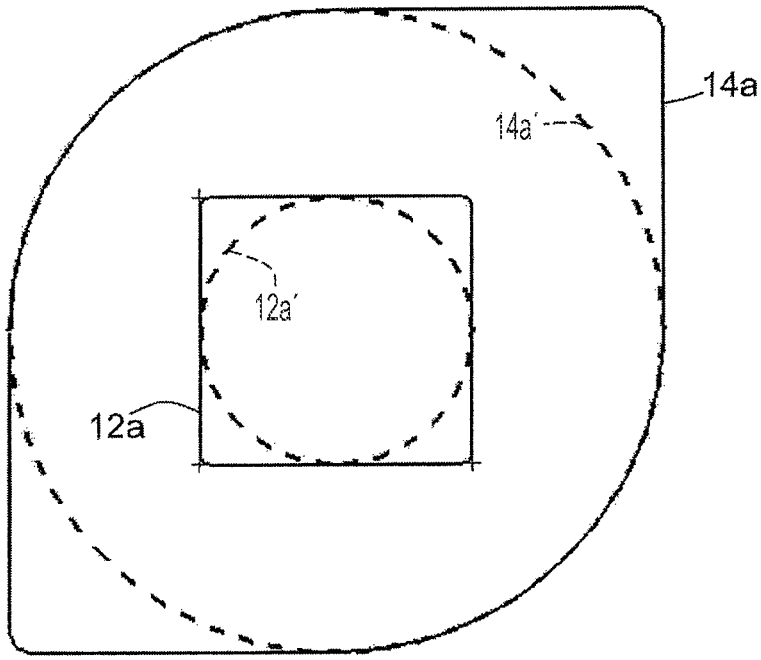
FIG. 3A depicts the respective cross sections of the elastomer torsion-spring elements, for which curves K1 and K2 were determined in FIG. 3, shown superimposed one on the other.

FIG. 3 shows a diagram in which in each case the above-mentioned characteristic curve K1 (restoring torque D in relation to the rotation angle ϕ) of the elastomer torsion-spring element according to the embodiment of the present invention depicted in FIG. 2 and a characteristic curve K2 of a conventional elastomer torsion-spring element (e.g., as known from EP 1486142 A1) have been plotted. The curves K1 and K2 in each case have been determined for elastomer torsion-spring elements in which the respective elastomers comprise the same material (rubber) so that the elastomer torsion-spring elements associated with the curves K1 and K2 essentially differ only in regard to the shapes of the respective internal casings and the shapes of the respective external casings. The progressions K1 and K2 first show that the restoring torque D increases as the rotation angle ϕ increases. In this exemplary embodiment the maximum rotation angle is 70°. The characteristic curve K1 of the elastomer torsion-spring element has been determined with reference to measurement series that were carried out with the elastomer torsion-spring element (lemon shape) shown in FIG. 2. In FIG. 3A, the cross sections of those elastomer torsion-spring elements are shown in relation to which the aforesaid curves K1 and K2 were determined. The two solid lines 14*a* or 12*a* indicate (in the sequence as stated) the contour of the contact surface of the external casing or the contour of the contact surface of the internal casing of the elastomer torsion-spring element which is associated with the characteristic curve K1; the two dashed lines 14*a*' or 12*a*' indicate (in the sequence as stated) the contour of the contact surface of the external casing or the contour of the contact surface of the internal casing of the conventional elastomer torsion-spring element which is associated with the characteristic curve K2. In order to allow a comparison of the cross-sectional shapes with the dimensions of the two elastomer torsion-spring elements, in FIG. 3A the respective cross sections of the two elastomer torsion-spring elements are shown superimposed one on the other.

As shown in the diagram in FIG. 3, the characteristic curve K1 of the elastomer torsion-spring element according to the embodiment of the present invention advantageously extends in a linear manner in almost all the rotary angle ranges. In contrast to this, the characteristic curve K2 of the conventional elastomer torsion-spring element, in particular in the initial rotary angle range, rises in a non-linear (progressive) manner. The diagram also shows that the characteristic curve K1 of the elastomer torsion-spring element according to the embodiment of the present invention, when compared to the characteristic curve K2 of the conventional elastomer torsion-spring element, is steeper. Thus, already at small rotation angles ϕ a greater restoring torque D is exerted. As a result of this, at an identical restoring torque D the elastomer material is deformed to a lesser extent when compared to the elastomer material of the conventional elastomer torsion-spring element. Advantageously the elastomer material is thus subjected to a lesser extent to loads and therefore is less prone to fatigue. This results in an extended service life.

It is known that elastomer torsion-spring elements can only be rotated up to a determined maximum rotation angle. Any further rotation beyond this maximum rotation angle would result in excessive non-linearity and ultimately in the rupture of the elastomer material. In the measurement series, for the purpose of plotting the characteristic curves K1 and K2, the elastomer torsion-spring elements to be compared were rotated to a rotation angle ϕ of a maximum of 70°.

Figure 3B:
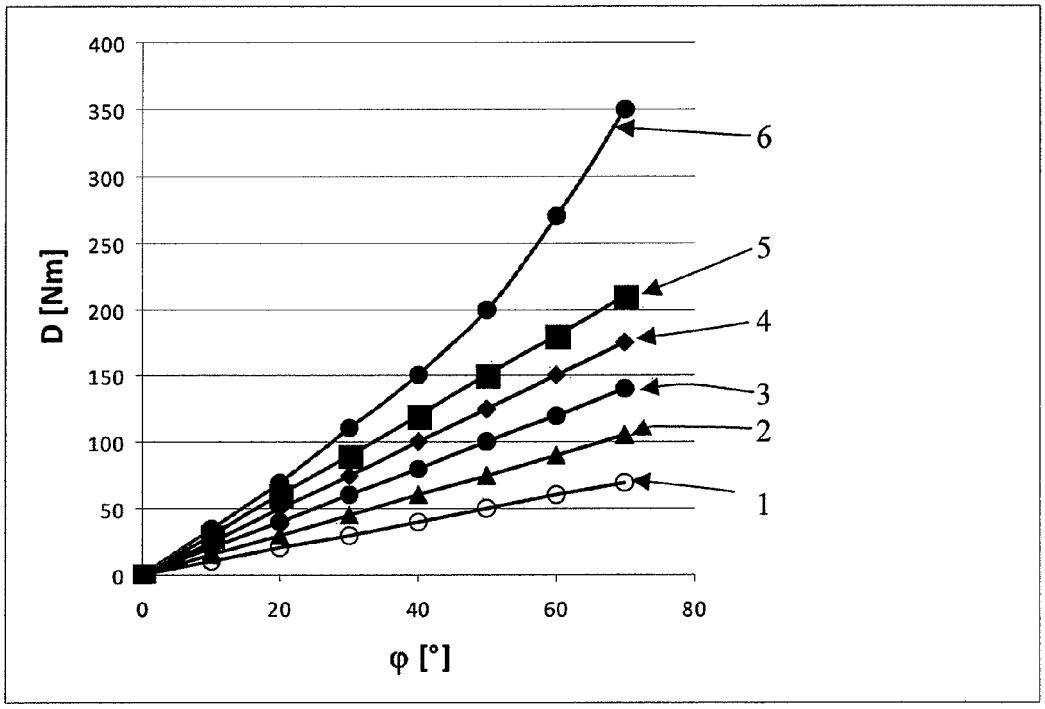
FIG. 3B depicts a diagram with characteristic curves of restoring torques as a function of the rotation angle for various embodiments of elastomer torsion-spring elements according to the invention.

FIG. 3B shows measured values, which represent the progression of the restoring torque D as a function of the rotation angle ϕ for six different embodiments of the elastomer torsion-spring element according to the invention. The curves, which correspond to the various embodiments, showing the progression of the restoring torque D, are in each case numbered (1-6). All the embodiments share a common feature in that the external casing 14 of the respective elastomer torsion-spring element 10 comprises a square profile, wherein the cross section of the contact surface 14*a* of the respective external casing 14 is a square with the side length of 60 mm (with regard to a sectional area perpendicular to the rotation axis 6). The various embodiments differ in that the cross section of the contact surface 12*a* of the internal casing 12 for the various embodiments comprises different shapes and different sizes. In the case of the curves 1 and 2 the cross section of the contact surface 12*a* of the internal casing 12 is a circle with the diameter 10 mm or 20 mm (in the sequence as stated). In the case of the curves 3-6 the cross section of the contact surface 12*a* of the internal casing 12 is a square with the side length of 20 mm or 25 mm or 30 mm or 40 mm (in the sequence as stated). In the case of the curves 3-6 it is assumed that the contact surfaces 12*a* of the internal casing 12 are arranged so as to be parallel to corresponding contact surfaces 14*a* of the external casing 14 if the rotation angle ϕ=0 and the restoring torque D=0. In all cases it is assumed that the respective elastomer body 16 comprises an identical material (rubber). A comparison of the curves 1-6 shows that the restoring torque D in the region of "small" rotation angles increases all the more pronouncedly with the rotation angle ϕ the greater the respective diameter in the case of curves 1 and 2, and the greater the respective side length of the cross sections of the contact surface 12*a* of the internal casing 12 in the case of curves 3-6. Furthermore, it has been shown that a square profile of the internal casing 12 results in a steeper increase in the restoring torque D as a function of the rotation angle ϕ than is the case with a round profile of the internal casing 12 with a correspondingly large diameter. Furthermore, it has been shown that the curves 1-5 in the region of 0-70° extend in a linear manner, while curve 6 shows a progressive rise above 40°. If with a view to a particular application there is an interest in the restoring torque D as a function of the rotation angle ϕ showing a linear progression across the widest possible rotary angle range (e.g. 0-70°), it is advantageous if the cross-sectional area of the internal casing 12 in relation to the cross-sectional area of the external casing 14 does not exceed a determined value.

A detailed analysis of the progressions, shown in FIG. 3B, of the restoring torque D as a function of the rotation angle ϕ for various elastomer torsion-spring elements that differ in relation to the shape of their cross sections perpendicular to the rotation axis 6 shows, that, for the elastomer torsion-spring elements according to embodiments of the invention, the surface area Fa of an internal cross section of the external casing 14 and the surface area Fi of an external cross section of the internal casing 12 are parameters that determine the range of the rotation angle ϕ across which the restoring torque D as a function of the rotation angle ϕ shows a linear progression. In the present case the internal cross section of the respective external casing 14 is a flat area that is arranged so as to be perpendicular to the rotation axis 6, with an outer edge which is delimited by the contact surface 14*a*. Correspondingly, the external cross section of the respective internal casing 12 is a flat area that is arranged so as to be perpendicular to the rotation axis 6 with an outer edge which is delimited by the contact surface 12*a*.

An analysis of the measured values shown in FIG. 3B has found that the elastomer torsion-spring elements which in each case correspond to the respective measured values in the rotary angle range $0 \leqq \phi \leqq 70°$ in each case show a linear progression of the restoring torque D as a function of the rotation angle ϕ, provided the following condition B1 applies in relation to the ratio of the surface area Fa to the surface area Fi:

$$Fa/Fi \geqq 7/3 \quad \text{(B1)}$$

If the dimensions of the respective elastomer torsion-spring element are selected in such a manner that Fa/Fi<7/3, then the restoring torque D generated by the elastomer torsion-spring element progressively increases as a function of the rotation angle ϕ (as indicated by progression 6 in FIG. 3B), wherein the restoring torque D increases all the more progressively as a function of the rotation angle ϕ the smaller the ratio Fa/Fi.

As already mentioned, the measurement data shown in FIG. 3A in each case relate to elastomer torsion-spring elements whose external casing 14 in each case comprises an internal cross section with a square shape. However, experiments have shown that the condition B1 is analogously applicable to other elastomer torsion-spring elements according to embodiments of the invention, even if the external casing of the respective elastomer torsion-spring element is shaped in such a manner that the internal cross section of the respective elastomer torsion-spring element does not comprise a square shape. For example, the elastomer torsion-spring elements shown in FIGS. 2 and 4-8 in the rotary angle range $0 \leqq \phi \leqq 70°$ in each case show a linear progression of the restoring torque D as a function of the rotation angle ϕ, provided the ratio of the surface area Fa of an internal cross section of the respective external casing to the surface area Fi of an external cross section of the respective internal casing according to the condition B1 in each case exceeds 7/3. The latter has been experimentally verified, in particular in relation to elastomer bodies 16 made of rubber.

Figure 3C:
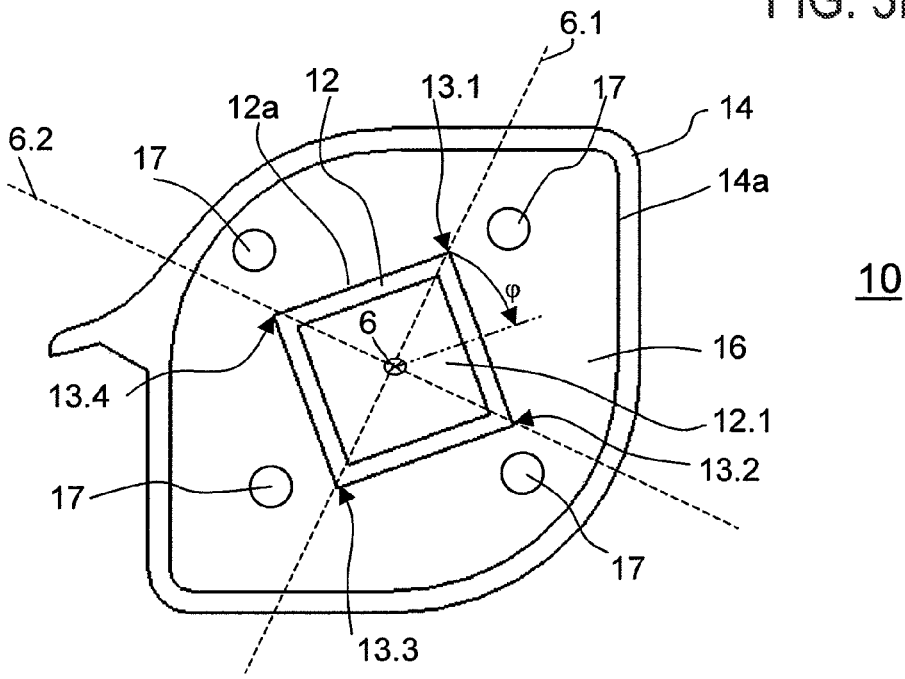
FIG. 3C depicts a diagrammatic lateral view of a further embodiment of an elastomer torsion-spring element according to the invention.

FIG. 3C shows a lateral view of an elastomer torsion-spring element 10 which differs from the elastomer torsion-spring element 10 according to FIG. 2 exclusively in that the elastomer body 16 of the elastomer torsion-spring element 10 according to FIG. 3C comprises four holes 17 which in each case extend along the rotation axis 6 in such a manner that they lead right through the elastomer body 16. In the present example each of the four holes 17 is placed near one of four edges 13.1, 13.2, 13.3 and 13.4 of the internal casing 12. As indicated in FIG. 3C the edges 13.1, 13.2, 13.3 and 13.4 are formed on the contact surface 12*a* of the internal casing 12, and in each case are arranged so as to be parallel to the rotation axis 6. The dashed line designated 6.1 in FIG. 3C denotes a plane in which both the rotation axis 6 and the edges 13.1 and 13.3 extend. Correspondingly, the dashed line designated 6.2 in FIG. 3C denotes a plane in which both the rotation axis 6 and the edges 13.2 and 13.4 extend. FIG. 3C shows the elastomer torsion-spring element 10 in a state in which the elastomer body 16 does not comprise any mechanical tension and thus does not generate any restoring torque between the internal casing 12 and the external casing 14. The arrow, designated ϕ, which extends from the edge 13.1, designates the progression of a path along which the edge 13.1 travels when the internal casing 12 is rotated by a rotation angle ϕ (in FIG. 3C clockwise) on the rotation axis 6, and is rotated relative to the external casing 14 in order to generate a restoring torque between the internal casing 12 and the external casing 14. The planes 6.1 and 6.2 divide the elastomer body 16 into four different regions, wherein in each case at least one subregion of each of these four regions is subjected to compressive loads when the internal casing 12 is rotated by the rotation angle ϕ on the rotation axis 6 and is rotated relative to the external casing 14. When the internal casing 12 is rotated on the rotation axis 6 and is rotated relative to the external casing 14, the elastomer body 16 is deformed, wherein the cross-sectional area of the respective hole 17 continuously decreases as the rotation angle ϕ increases. As already mentioned, this change in the shape of the holes 17 has the effect that an expansion of the elastomer body 16, which expansion is generated along the rotation axis 6 as a result of the above-mentioned compressive load, is at least in part compensated for. This prevents the elastomer body 16 from being damaged or subjected to wear when the internal casing 12 is rotated relative to the external casing 14 by a relatively large rotation angle ϕ.

Figure 4:
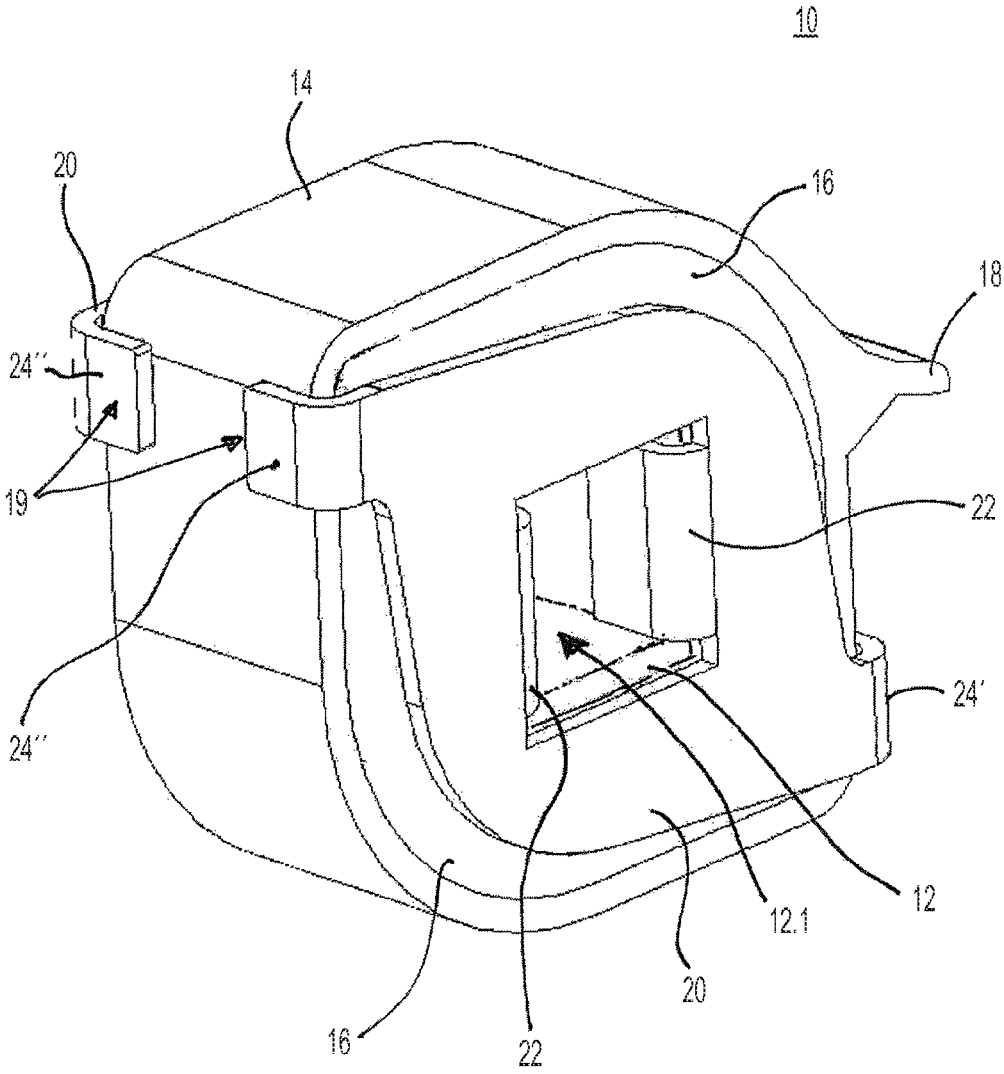
FIG. 4 depicts the elastomer torsion-spring element in the first exemplary embodiment, which is pre-tensioned by a retaining element.

FIG. 4 shows a perspective view of the elastomer torsion-spring element 10 shown in FIG. 2 in a first embodiment of the present invention with a retaining element 19. The retaining element 19 is used to hold the internal casing 12 and the external casing 14 in a "normal position" relative to each other, in which normal position the elastomer body 16 comprises mechanical pre-tension, and thus generates a restoring torque D, between the internal casing 12 and the external casing 14, which restoring torque D differs from zero. In this "normal position" the internal casing, when compared to the "non-rotated" position (without pre-tension) according to FIG. 2, is rotated by a rotation angle Δϕ (hereinafter referred to as the "pre-tension angle") namely clockwise in relation to FIG. 2, and counter clockwise in relation to FIG. 4. In this example the retaining element 19 comprises two tensioning elements 20, which in each case have been fitted to one of the faces of the elastomer torsion-spring element 10. The tensioning element 20 is an essentially flat plate which in the middle region is punched in such a manner that two opposite flanges 22 remain. These flanges 22 are in each case bent inwards (into the drawing plane) by 90°. An outside region of the tensioning element 20 comprises brackets 24', 24" which are also bent inwards by 90°.

To install the tensioning element 20 on the elastomer torsion-spring element 10 the flanges 22, which are designed in such a manner that their external regions are connectable in a positive-locking manner to the internal surface of the internal casing 12, are inserted by a first distance in the internal casing 12. Thereafter the tensioning element 20 and the internal casing 12, which is connected to the aforesaid in a radially positive-locking manner, with a fixed external casing 14, are rotated counter clockwise by a defined angle (for example 20°) in relation to the external casing 14.

Subsequently the flanges 22 of the tensioning element 20 are completely pushed into the channel 12.1 of the internal casing 12, wherein at the same time the brackets 24', 24" establish a positive-locking connection to the external surface of the external casing 14. Installed in such a manner the tensioning element 20 maintains the pre-tension. Expressed more precisely, it is no longer possible to select an angle smaller than the pre-tension angle Δϕ, because the brackets 24', 24" come to rest against the external surface of the external casing 14. However, an increase in the rotational offset (also counter clockwise) between the internal casing 12 and the external casing 14 is possible. In the case of an increase in this rotational offset the internal regions of the brackets 24', 24" slide along the external surface of the external casing or are lifted off the aforesaid. In order to prevent the destruction of the elastomer torsion-spring element 10, in this example a maximum rotation angle between the internal casing 12 and the external casing 14 (for example 70°) cannot be exceeded. This is because at the maximum rotation angle ϕ the bracket 24' comes to rest against the cam 18 of the external casing, as a result of which any further rotation is advantageously prevented.

Figure 5:
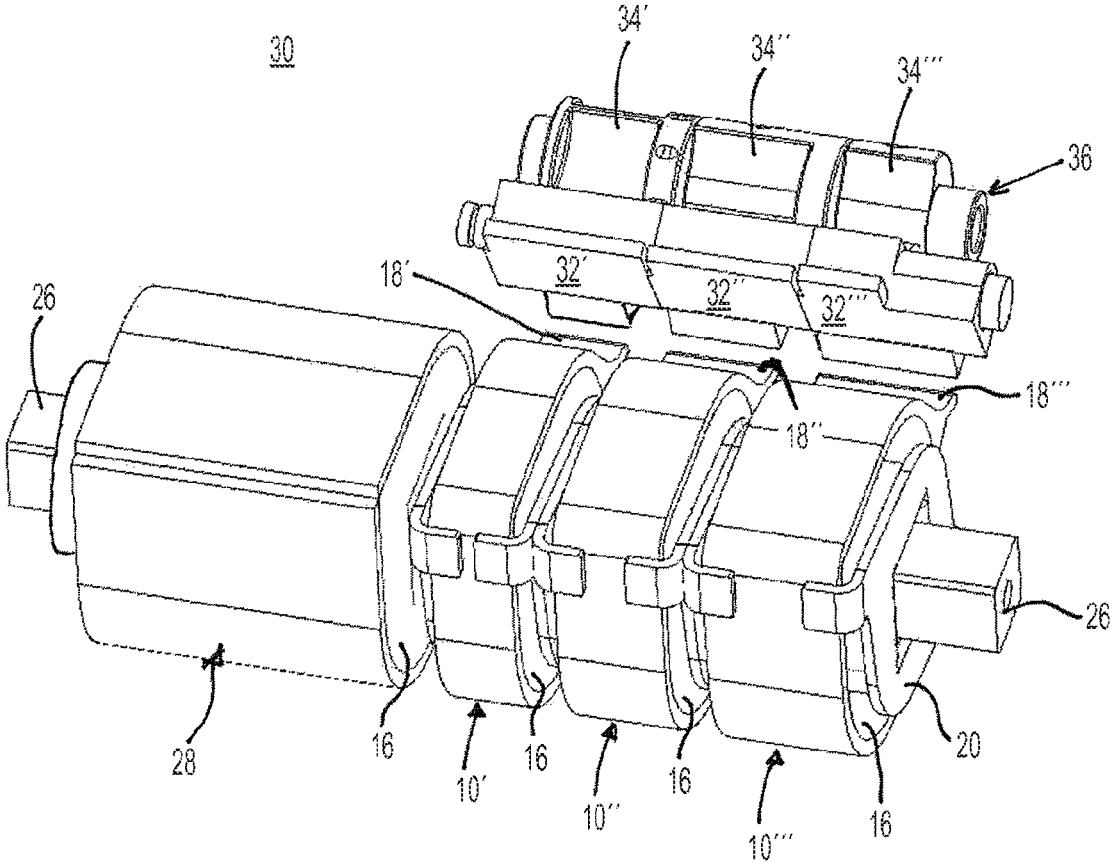
FIG. 5 depicts an exemplary use of four elastomer torsion-spring elements in the first exemplary embodiment, which are installed in the power system of a chair.

FIG. 5 shows three elastomer torsion-spring elements 10'-10'" in each case with tensioning elements 20 put in place at the face, as shown in detail in FIG. 4. These elastomer torsion-spring elements 10'-10'" have been fitted onto a bearing shaft 26 by way of their internal casings 12. The bearing shaft 26 and the respective regions of the internal casings 12 of the respective elastomer torsion-spring elements 10'-10'" are dimensioned in such a manner that a radially positive-locking connection is established. The bearing shaft 26 is also radially inserted in a positive-locking manner in the internal casing of an elastomer torsion-spring base-element 28. This arrangement forms a device 30 for transmitting power for a chair (not shown in FIG. 5, but shown in FIG. 1), hereinafter referred to as the "power system" 30. This power system 30 is in principle used to apply a restoring torque to a back support or a seat base of the chair for those cases where the back support or the seat base is pivoted relative to a support for the back support or for the seat base. The power system 30 is connected, by way of the external casing of the elastomer torsion-spring base-element 28, to the essentially rigid support (not shown) of the chair. At its axial end sections the bearing shaft 26 is connected in a rotationally fixed manner to the back support. If a person seated on the chair reclines with the back piece, the back support and any seat support that may be synchronously articulated to said back support is pivoted. Since the back support is connected to the bearing shaft 26 in a rotationally fixed manner, the bearing shaft 26 is rotated (in the example shown rotation is counter clockwise). This rotation is always counteracted by at least some restoring torque caused by the elastomer torsion-spring base-element 28.

FIG. 5 furthermore shows blocking elements 32'-32'" which are articulated to a shaft that extends parallel to the bearing shaft 26. The blocking elements 32'-32'" can be controlled by way of locking lugs 34'-34'" which have been radially affixed to a camshaft 36. During activation the blocking elements 32'-32'" are in each case discretely pivoted, separately of each other, into two different positions. In the example shown in FIG. 5, all the blocking elements 32'-32'" are presently arranged in such a manner that they do not establish contact with the external-casing cams 18'-18'" which have been formed on the respective external casings of the elastomer torsion-spring elements 10'-10'" so that the blocking elements 32'-32'" and the elastomer torsion-spring elements 10'-10'" are in a decoupled state. The camshaft 36, which extends parallel to the bearing shaft 26, can be rotated in such a manner that the individual locking lugs 34'-34'" assume a changed position in which one or several blocking elements 32' or 32" or 32'" (depending on the respective position of the camshaft 36 after respective rotation) are pivoted into a position in which those blocking elements 32' or 32" or 32''' which during the respective rotation of the camshaft 36 were pivoted are made to establish contact with the respective external-casing cams 18' or 18" or 18''' of the respective elastomer torsion-spring elements 10'-10''', and thus are coupled to the respective elastomer torsion-spring elements 10'-10''' (not shown in FIG. 5). In this coupled state those blocking elements 32' or 32" or 32''' which were pivoted during the respective rotation of the camshaft 36 affix the external casings of the respective elastomer torsion-spring elements 10'-10''' in a predefined position.

In the example shown in FIG. 5, there is no coupling between the blocking elements 32'-32''' and the external-casing cam 18'-18''' so that if a person seated on the chair were to recline, as described above, the bearing shaft 26 would rotate counter clockwise, and the elastomer torsion-spring elements 10'-10''' as an entity would follow the rotation of the bearing shaft 26. As described above, in this example the entire restoring torque D provided by the power system 30 is identical to the restoring torque which is caused exclusively by the elastomer torsion-spring base-element 28. Accordingly, the elastomer torsion-spring elements 10'-10''' do not contribute to the restoring torque D provided by the power system 30.

In a changed rotation of the camshaft 36 it is, for example, possible to implement a coupling between one or several blocking elements 32'-32''' and one or several external-casing cams 18'-18'''. Thus those elastomer torsion-spring elements 10'-10''' which are coupled to one of the respective blocking elements 32'-32''' are locked by their external casings. This results in the entire restoring torque which is provided by the power system 30 consisting of the sum of all restoring torques which are caused by the elastomer torsion-spring base-element 28 and those elastomer torsion-spring elements 10'-10''' which in each case by means of the respective blocking elements 32'-32''' are locked. Expressed more precisely, the entire restoring torque can be set depending on the rotation of the camshaft 36.

As shown in FIG. 5, the elastomer torsion-spring elements 10'-10''' comprise different dimensions. This means that in each case they can cause different restoring torques. In this example the elastomer torsion-spring element 10''' causes a greater restoring torque than does the elastomer torsion-spring element 10" which in turn causes a greater restoring torque than does the elastomer torsion-spring element 10'. By means of corresponding separate coupling or decoupling of individual elastomer torsion-spring elements 10'-10''' thus a total of eight different restoring torques can be selected. Consequently, restoring torques can be switched which in each case correspond to the individual body weight of a person seated on the chair. In this way by suitable coupling or decoupling of the respective elastomer torsion-spring elements 10'-10''' and the respective blocking elements 32'-32''' a person with, for example, a body weight of 45 kg can experience an ergonomically adjusted restoring force just as much as a person with, for example, a body weight of 120 kg can experience an ergonomically adjusted restoring force. Due to the eight different stages described above, persons with a body weight ranging, for example, between 45 kg and 120 kg can be supported in an ergonomically optimal manner. This considerably improves the seating comfort.

Figure 6:
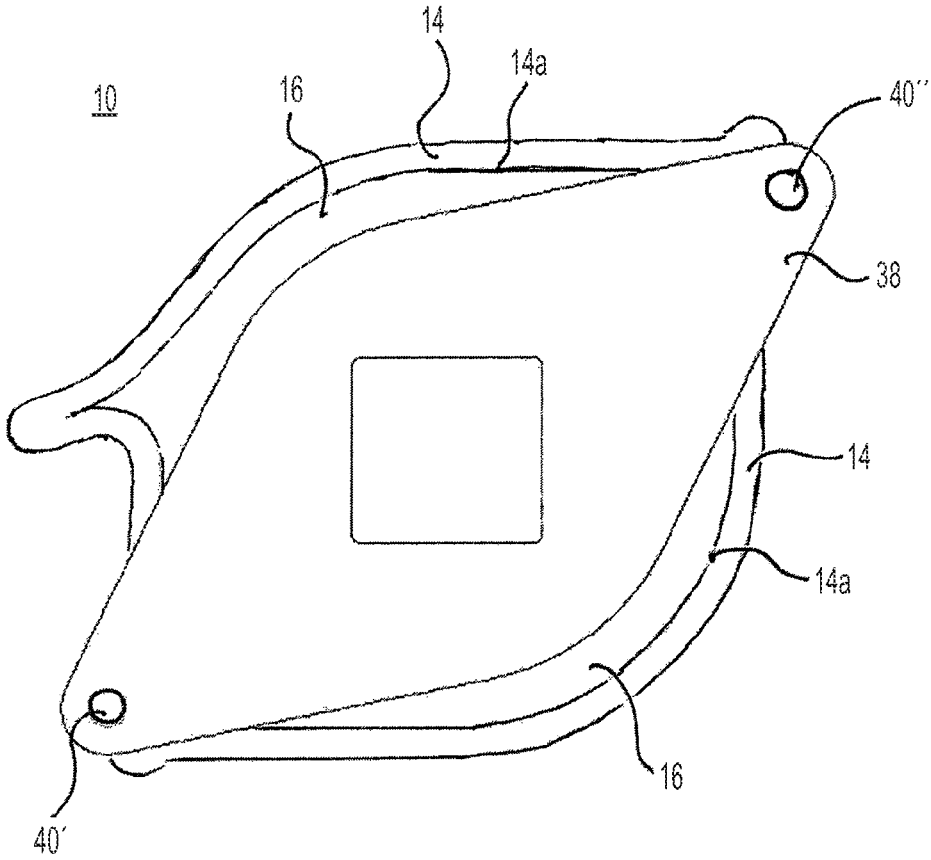
FIG. 6 depicts an elastomer torsion-spring element in a second exemplary embodiment, which is pre-tensioned by a retaining element.

FIG. 6 shows an elastomer torsion-spring element 10 in a second embodiment. In this embodiment the internal casing (not shown) and the external casing 14 in relation to each other are pre-tensioned by means of a tensioning element 38. For a more detailed description of this elastomer torsion-spring element, reference is made to FIGS. 7A-7C.

Figure 7A:
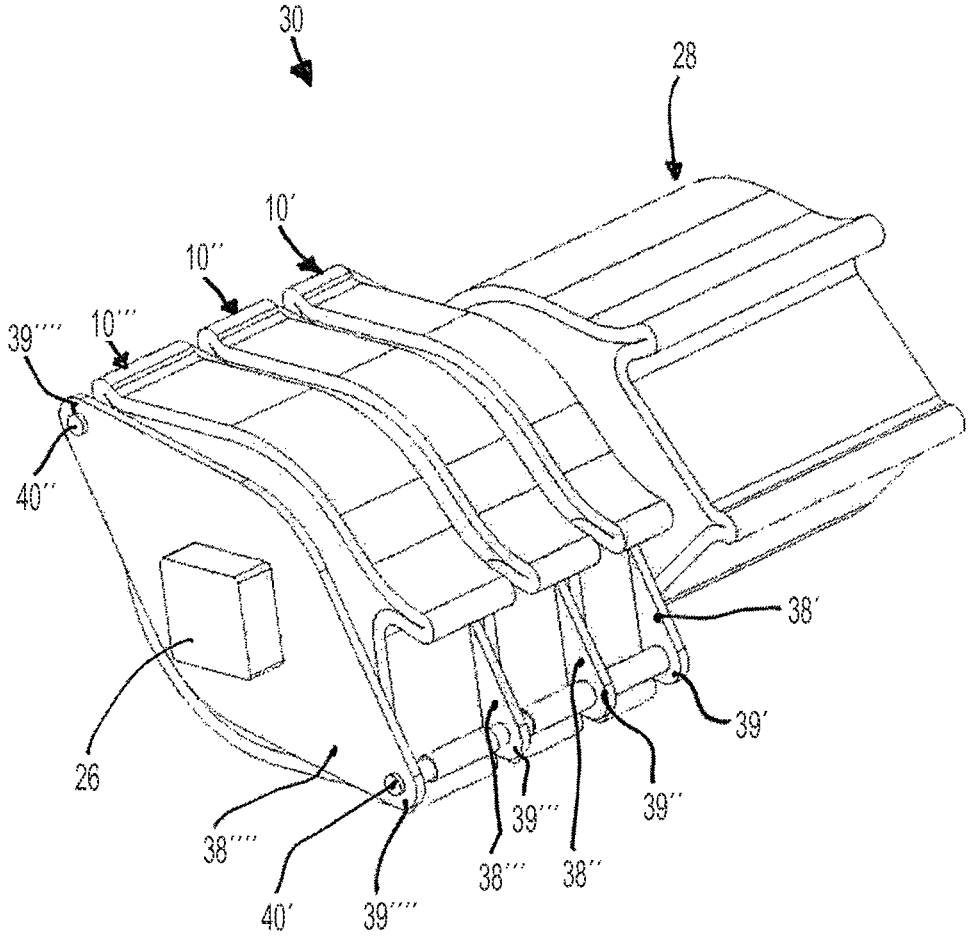
FIGS. 7A-7C depict a further exemplary use of three elastomer torsion-spring elements in the second exemplary embodiment, which in each case are pre-tensioned by a retaining element and which are installed in the power system of a chair.
Figure 7B:
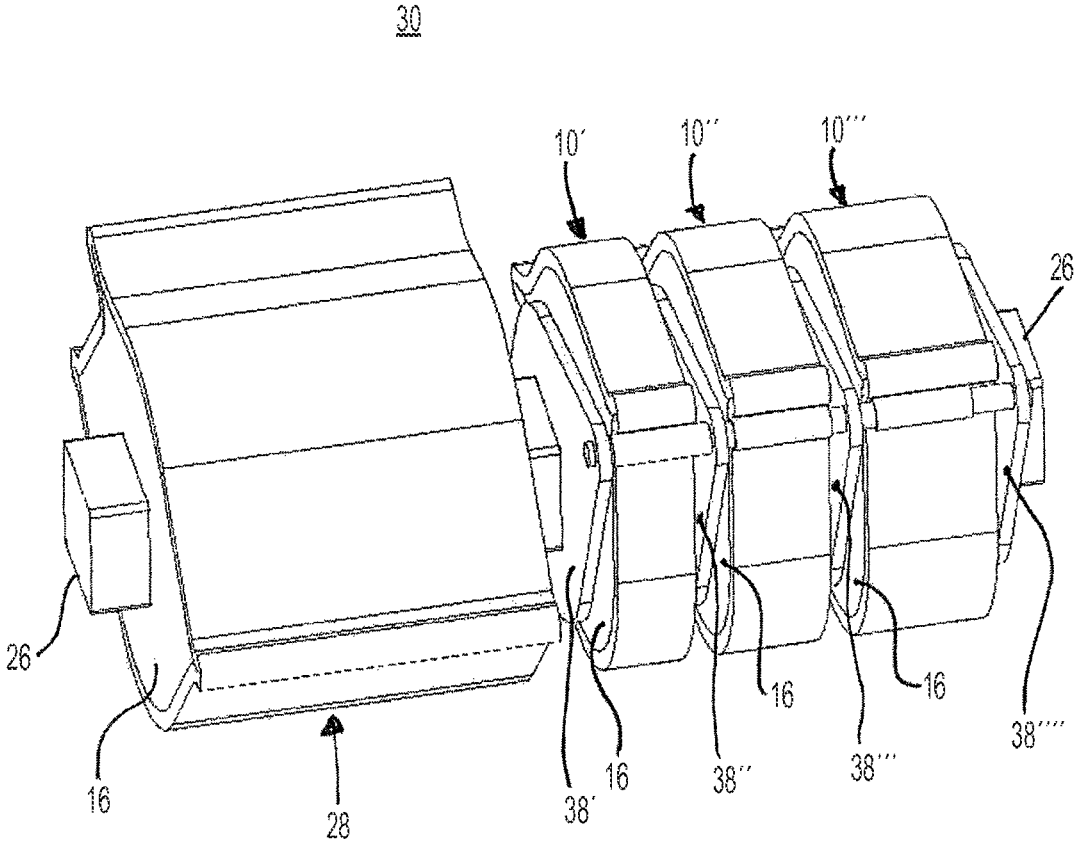
Figure 7C:
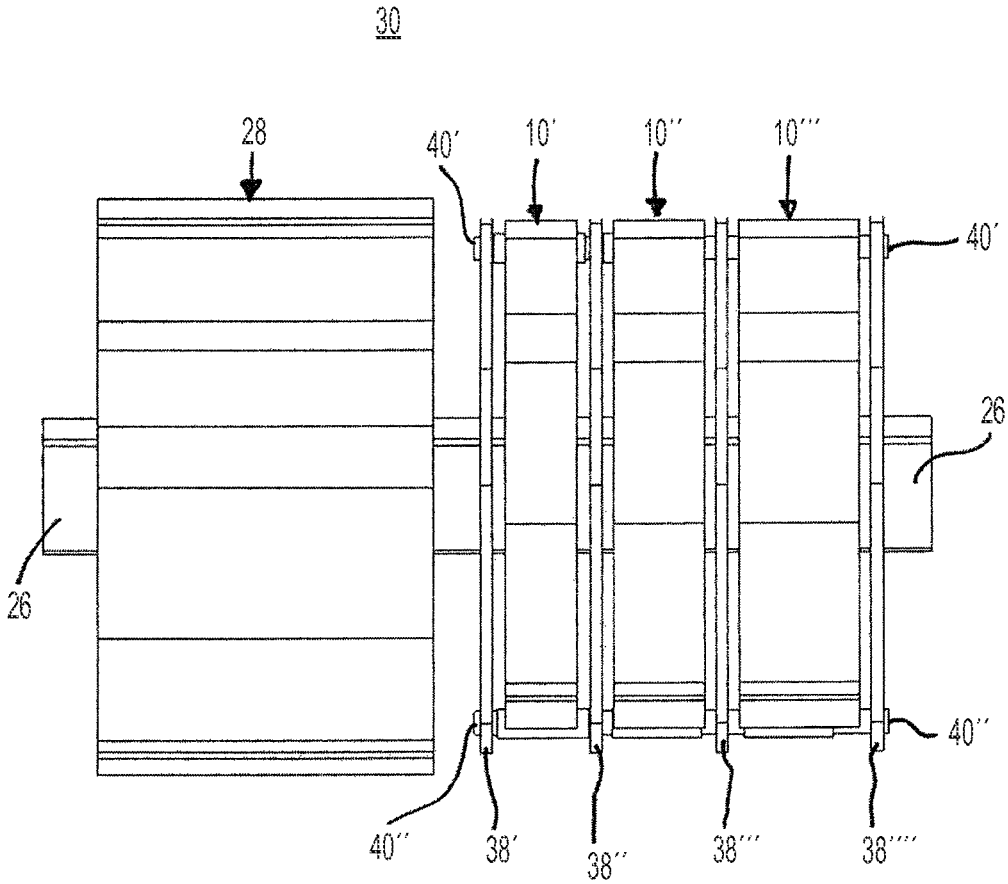

FIGS. 7A-7C in each case show various views of a power system 30 which, in a manner similar to the example shown in FIG. 5, also comprises three elastomer torsion-spring elements 10'-10'''. These three elastomer torsion-spring elements 10'-10''' are in each case built according to the embodiment shown in FIG. 6. The power system 30 furthermore comprises an elastomer torsion-spring base-element 28 and a shaft 26. The example shown comprises tensioning elements 38'-38'''' which differ from the tensioning elements 20 shown in FIGS. 4 and 5. The tensioning elements 38'-38'''' shown are plate-like elements whose internal regions have been punched out so that they are rectangular. In this arrangement the contour of the punched-out opening matches the external contour of the (square) bearing shaft 26 in a positive-locking manner. The external regions of the tensioning elements 38'-38'''' comprise curvatures 39'-39'''' which in each case comprise a perpendicular through-hole.

During installation of the power system 30 the bearing shaft 26 and the internal casing of the elastomer torsion-spring base-element 28 are radially interconnected in a positive-locking manner. Subsequently a first tensioning element 38' by way of its punched-out opening is fitted onto the bearing shaft 26 so that between the bearing shaft 26 and the tensioning element 38', too, a connection having a radially positive fit is established. Thereafter, a first elastomer torsion-spring element 10' is placed on the bearing shaft 26. Following on from this step a further tensioning element 38" is put in place, etc. After all three elastomer torsion-spring elements 10'-10''', in each case with tensioning elements 38'-38''' placed in between, have been placed onto the bearing shaft 26, finally the last tensioning element 38'''' is placed on the face side.

Subsequently the elastomer torsion-spring elements 10'-10''' are pre-tensioned, either individually or simultaneously, in that for example their external casings, with a radially fixed bearing shaft 26, are rotated clockwise on the longitudinal direction of the bearing shaft 26. This rotation continues up to a rotation angle at which pins 40', 40" can be inserted through the respective boreholes of the curvatures 39'-39''''. After the pins 40', 40" have been inserted through these boreholes, the introduction of force in order to rotate the external casing is terminated. In this state the individual elastomer torsion-spring elements 10'-10''' remain in this position because the respective external surfaces of the external casing then come to rest against the circumferential section of the pins 40', 40". It is then no longer possible for the respective external casing to be rotated back to the initial state.

There is an advantage associated with the arrangement and the design of the tensioning elements 38'-38'''' in that now, in contrast to the example shown in FIGS. 4 and 5, no flange is inserted into the respective internal casings of the elastomer torsion-spring elements 10'-10'''. Thus the bearing shaft 26 radially engages in a positive-locking manner the entire internal surface of the respective internal casing. Consequently any play between the bearing shaft 26 and the internal casing of the elastomer torsion-spring elements 10'-10''' is avoided. In contrast to this, in the case of the example shown in FIGS. 4 and 5 there is bearing play as a result of the introduction of the restoring torque of the respective elastomer torsion-spring elements 10'-10''' in the bearing shaft 26 in some sections taking place by way of the flanges 22, and the internal casings of the respective elastomer torsion-spring elements 10'-10''' therefore cannot establish mechanical contact with the bearing shaft 26 (see FIGS. 4 and 5).

The example shown in FIGS. 7A-7C is associated with a further advantage in that the installation is considerably simpler, when compared to the installation in the example shown in FIGS. 4 and 5, in which embodiment each elastomer torsion-spring element has previously been equipped with its tensioning elements 20. Furthermore, the installation time is greatly reduced. A further advantage consists of the far simpler and less time-intensive manufacture of the individual tensioning elements 38'-38''''. These can simply be manufactured in a cost-effective manner by means of punching.

Figure 8A:
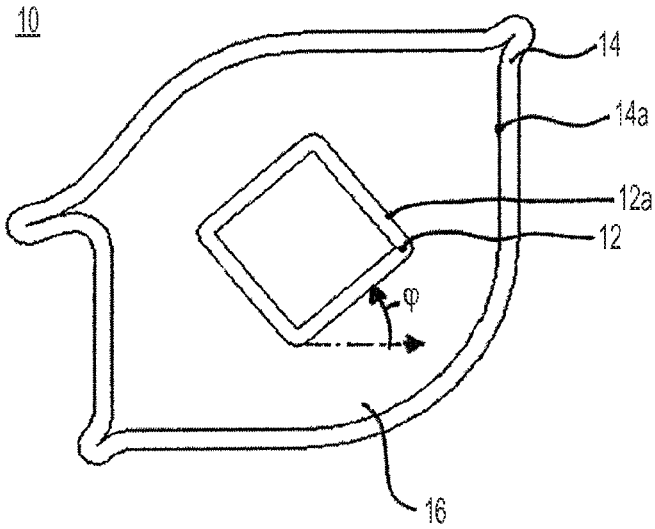
FIGS. 8A-8C depict an elastomer torsion-spring element in the second exemplary embodiment with various positions of the internal casing relative to the external casing, wherein the internal casing and the external casing are rotated relative to each other by different rotation angles.
Figure 8B:
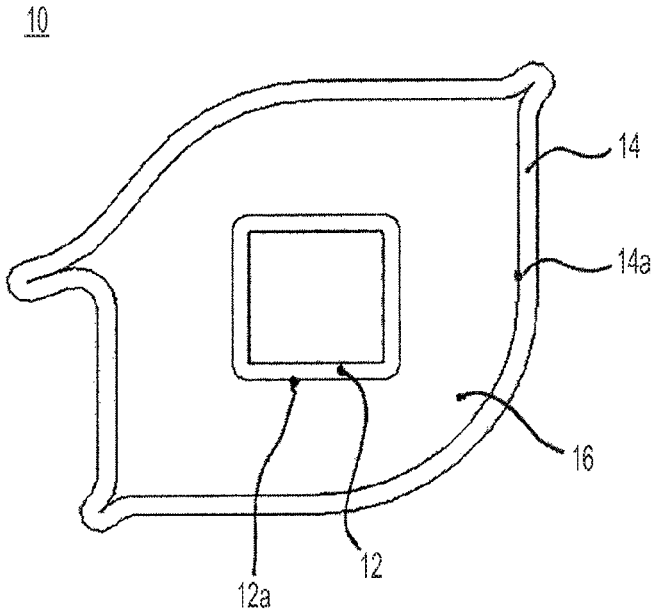
Figure 8C:
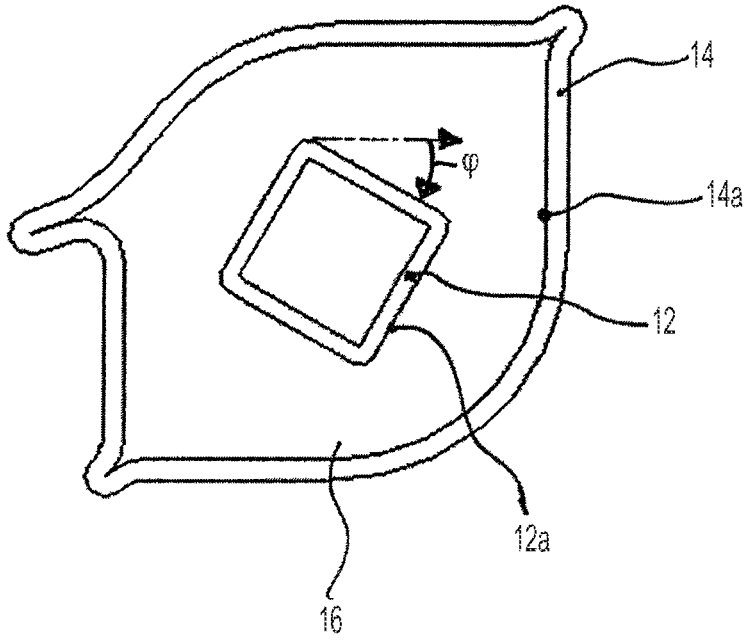

FIGS. 8A-8C in each case show an elastomer torsion-spring element 10 in the second exemplary embodiment in which the internal casing 12 and the external casing 14 in relation to each other in the sequence of the figures are rotated relative to each other by an increasing rotation angle $\phi$. In FIG. 8A the elastomer torsion-spring element 10 is shown in an non-rotated initial state, wherein it is assumed that the elastomer body 16 in this state does not comprise any elastic deformation and thus does not generate any restoring torque between the internal casing 12 and the external casing 14 (D=0). In this state the internal casing 12 and the external casing 14 are arranged in relation to each other so as to be rotated counter-clockwise at a rotation angle $\phi$ of −40°. In FIG. 8B the elastomer torsion-spring element 10 is shown in a clockwise rotated state. In this arrangement the internal casing 12 is arranged relative to the external casing 14 at a rotation angle of $\phi$=0°. Expressed more precisely, the internal casing 12 and the external casing 14 in relation to each other, when compared to the initial state shown in FIG. 8A, are rotated by $\Delta\phi$=40°. In FIG. 8C the elastomer torsion-spring element 10 is shown in the rotated state, wherein the internal casing 12 when compared to the states according to FIG. 8A is rotated by $\Delta\phi$=70°.

There is an advantage associated with the rotational offset by −40° between the internal casing 12 and the external casing 14 when compared to the non-rotated initial state (FIG. 8A) in that further rotation between the internal casing 12 and the external casing 14 in relation to each other in clockwise direction (see FIGS. 8B-8C) takes place in a rotary angle range in which the characteristic curve of the restoring torque as a function of the rotation angle $\phi$ extends in a linear manner across a large angle range and comprises a particularly steep gradient as a function of the rotation angle.

Figure 9:
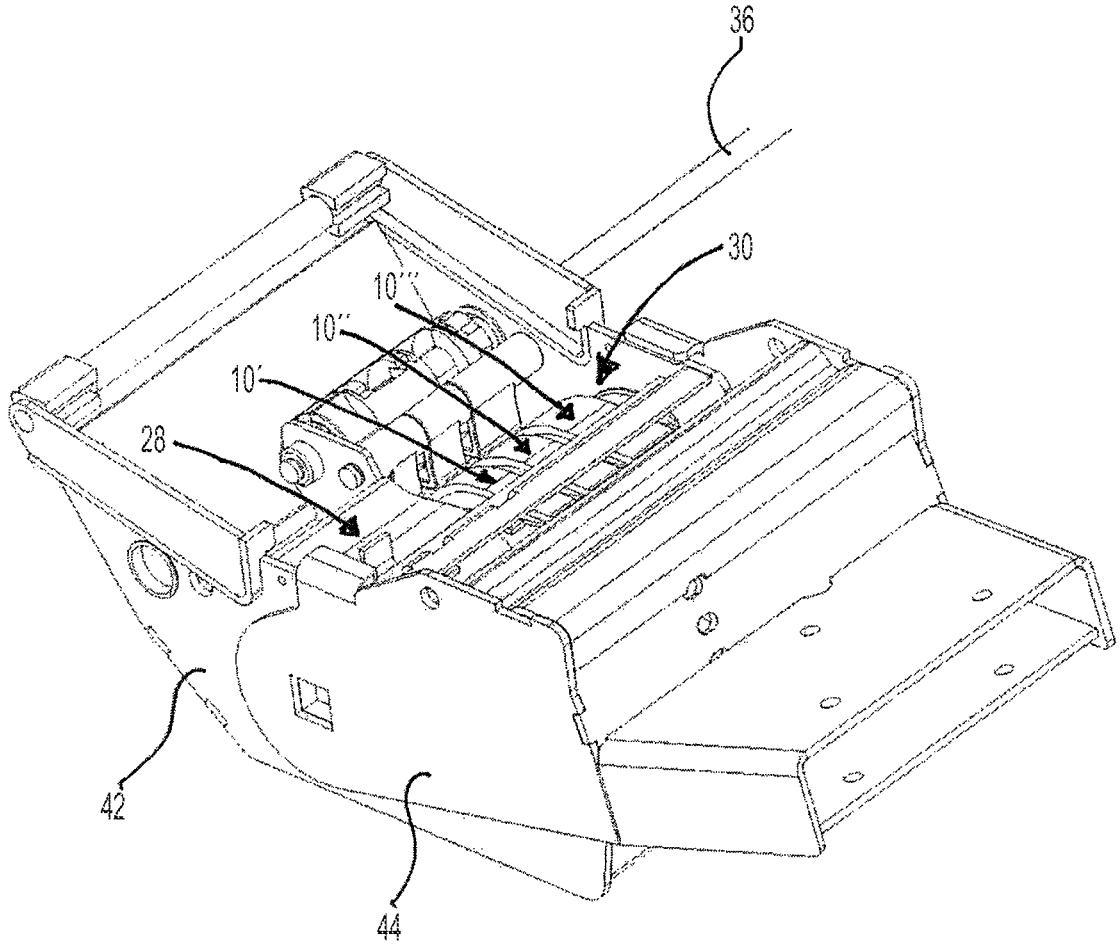
FIG. 9 depicts the elastomer torsion-spring elements in the second exemplary embodiment, which are assembled to form a power system that is installed in the support of a chair.

FIG. 9 shows the power system 30 illustrated in FIGS. 7A-7C which is installed in a support 42 of a chair (not shown in FIG. 9). In this arrangement the elastomer torsion-spring base-element 28 is rigidly connected, by way of its external casing, to the support 42. Through an opening in the support 42 the bearing shaft (not shown) can be coupled in a rotationally fixed manner to a section of a back support 44. The back support 44 in turn is used to receive a back piece 3 according to FIG. 1 (not shown in FIG. 9) to which back piece 3 a backrest 4 according to FIG. 1 is connected, which backrest 4 extends so as to be essentially perpendicular. The backrest 4 can thus be pivoted against the restoring torque introduced by the power system 30. Furthermore, a seat support for a seat base 5 according to FIG. 1 can be connected to the back support 44 and/or to the backrest so that the seat base 5 can be pivoted synchronously to the backrest 4.

As already described in the context of the power system 30 shown in FIG. 5, the bearing shaft 26 is rotated as soon as a person seated on the chair reclines. In the example shown in FIG. 9, the bearing shaft would rotate clockwise when a person reclines. In a state in which the external-casing cams (not shown) of the respective elastomer torsion-spring elements 10'-10''' of the power system 30 are not coupled to the support by way of the blocking elements the individual elastomer torsion-spring elements 10'-10''' would follow this rotation.

Depending on a respective rotation of the camshaft 36, the individual blocking elements 32'-32''', in each case activated by individual locking lugs 34'-34''' arranged on the camshaft 36, can be switched in such a manner that they are coupled to the respective external-casing cams 18'-18''' of the elastomer torsion-spring elements 10'-10'''. If a coupled state with any desired external-casing cam 18'-18''' of an elastomer torsion-spring element 10', 10'' or 10''' is established, then this coupled elastomer torsion-spring element 10', 10'' or 10''' would apply its respective restoring torque, in addition to the restoring torque of the elastomer torsion-spring base-element 28, to the bearing shaft 26. Thus the elastomer torsion-spring elements 10', 10'' or 10''' are advantageously designed and arranged in such a manner that they, individually switched, apply to the back support a restoring torque that is linear to the rotation angle, which restoring torque is adjusted to the body weight of a person seated on the chair. In this way an optimal restoring force is applied against the back of the person, and consequently seating comfort is improved.

Figure 10A:
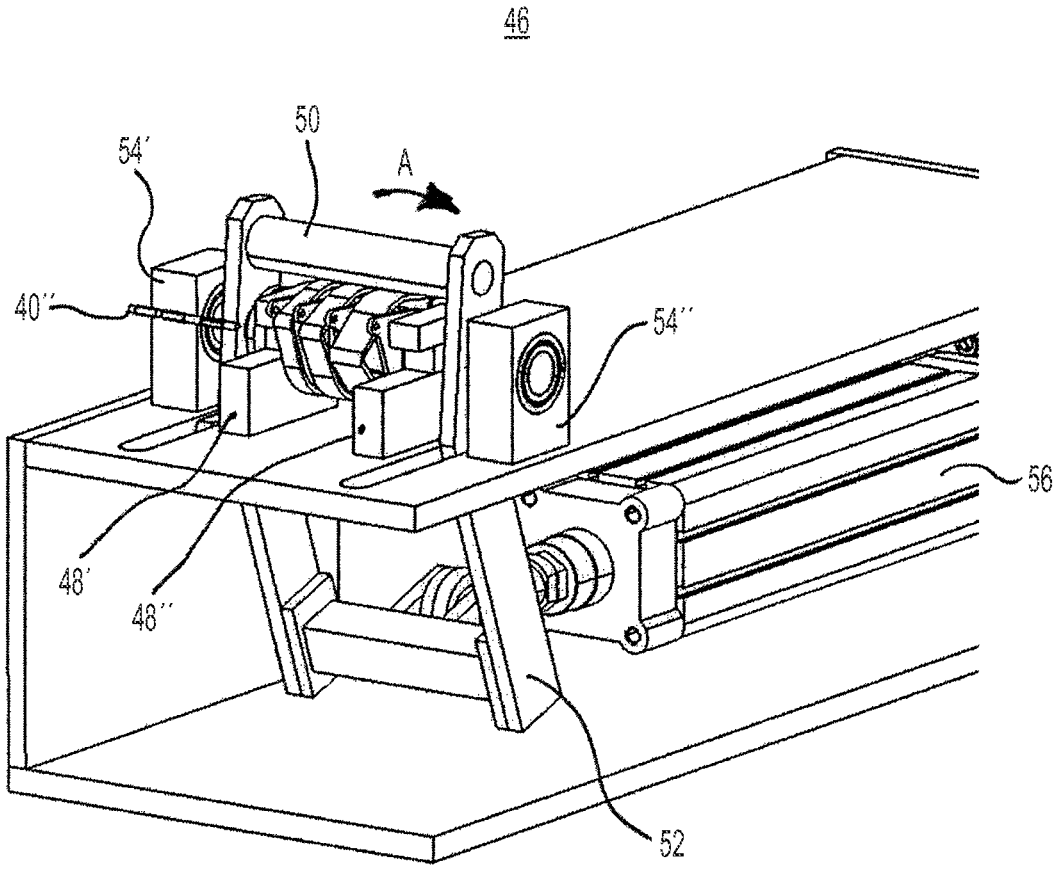
FIGS. 10A-10E depict a tensioning device to manufacture the power system shown in FIGS. 7A-7C.
Figure 10B:
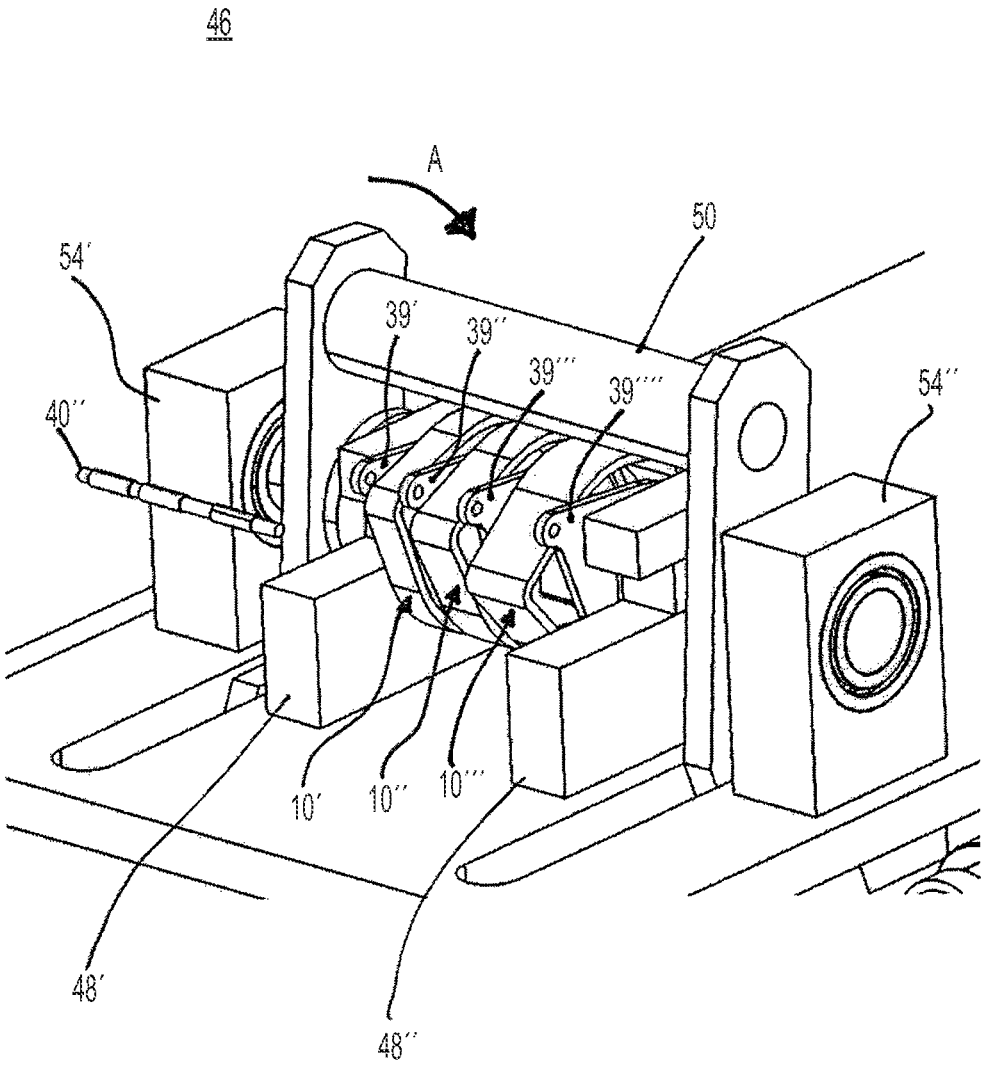
Figure 10C:
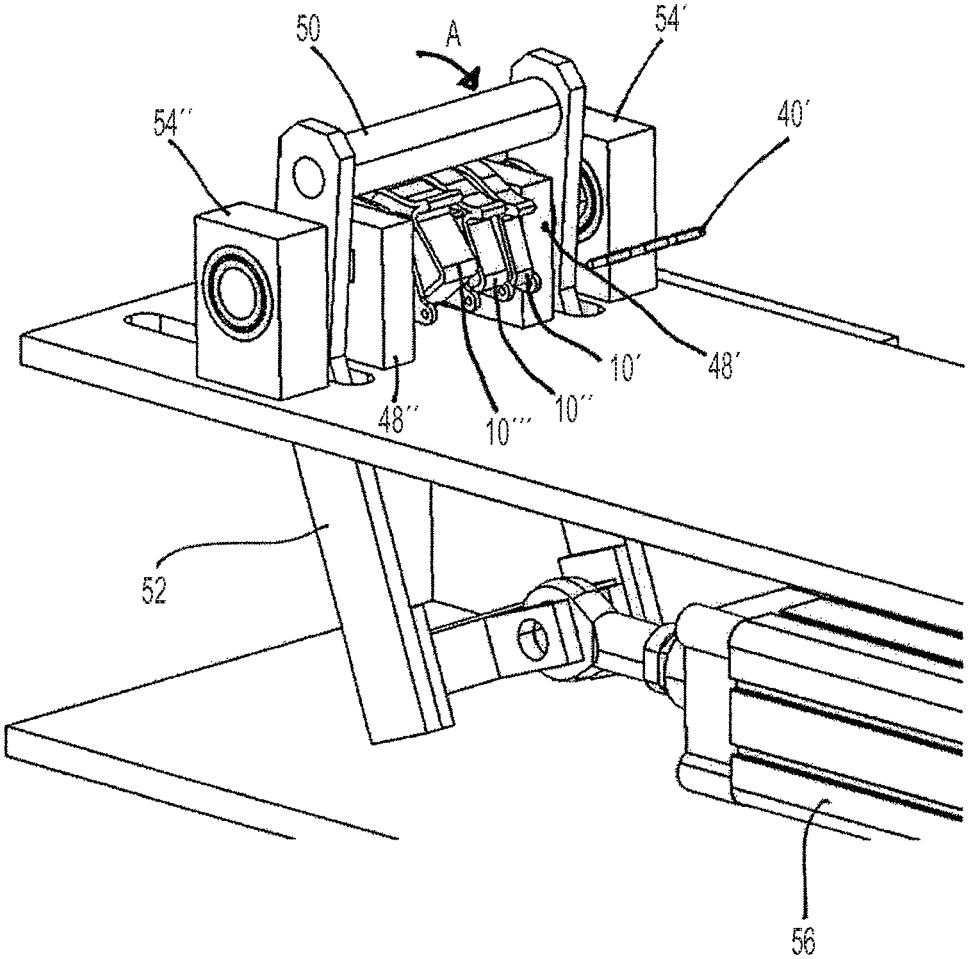
Figure 10D:
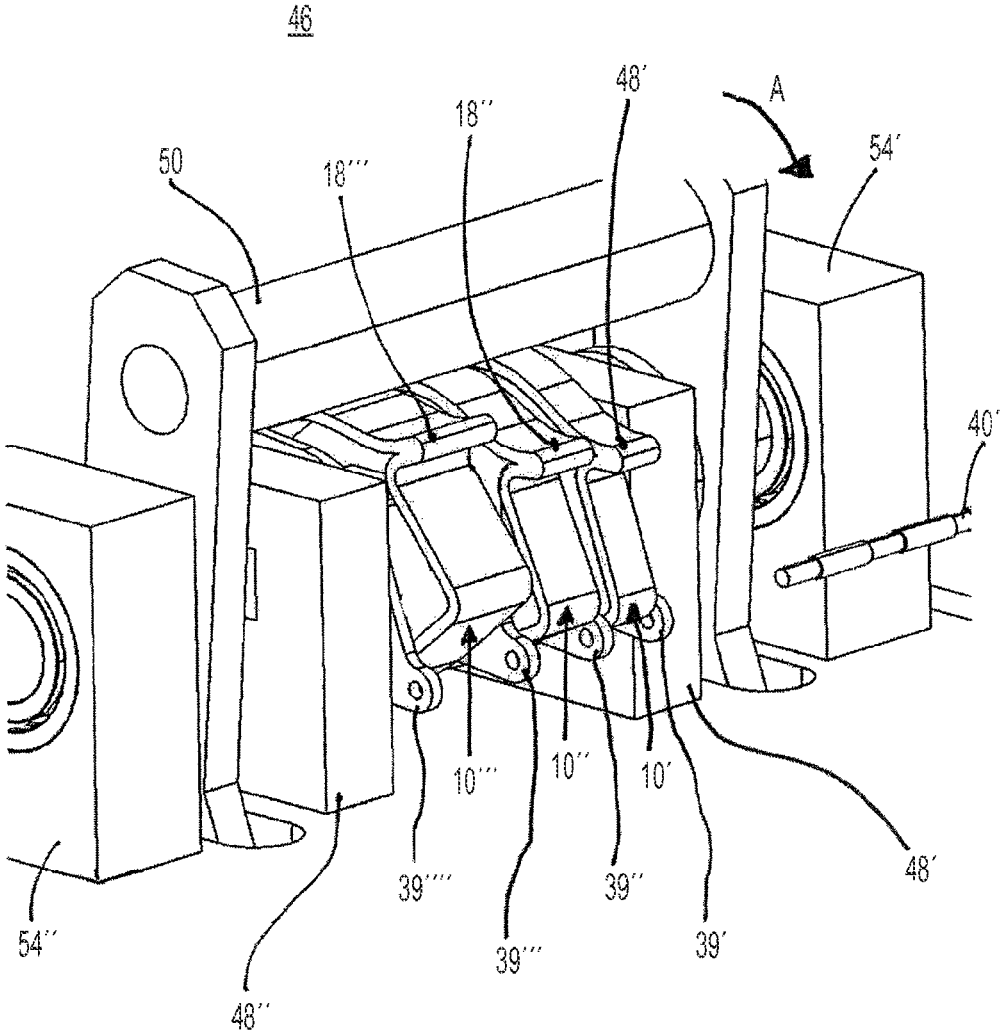

FIGS. 10A-10E show different views of a tensioning device 46 for pre-tensioning the elastomer torsion-spring elements 10'-10''' with the tensioning elements 38'-38'''' put in place in between and on the face side, shown in FIGS. 7A-7C. In FIGS. 10A and 10C in each case a complete view of the tensioning device 46 is shown, viewed from different directions. In FIGS. 10B and 10D in each case a detailed view of the tensioning device 46 is shown, viewed from different directions. The tensioning device 46 is used for simple and quick pre-tensioning of the individual elastomer torsion-spring elements 10'-10''' with only a few steps. The tensioning device comprises affixation devices 48', 48'' which affix the bearing shaft 26 (not shown in FIGS. 10A-10E) so that it is fastened by its axial ends. As explained above in the context of the description relating to FIGS. 7A-7C, the individual elastomer torsion-spring elements 10'-10''' have previously been fitted onto the bearing shaft 26, wherein the tensioning elements 38'-38'''' have in each case been put in place in between and on the face side. These tensioning elements 38'-38'''' are in each case radially connected to the bearing shaft in a positive-locking manner.

The tensioning device 46 furthermore comprises a bar 50, which is perpendicularly connected between two lever arms of a lever 52. The lever arms are pivotably hinged by way of tensioning device bearings 54', 54''. At its lower end the lever 52 can be deflected forwards and backwards by way of a drive 56. In the case of a deflection of the lower section of the lever 52 in a direction away from the drawing plane of FIG. 10A, the bar 50 is deflected towards the elastomer torsion-spring elements 10'-10''' as indicated by the arrow A.

Figure 10E:
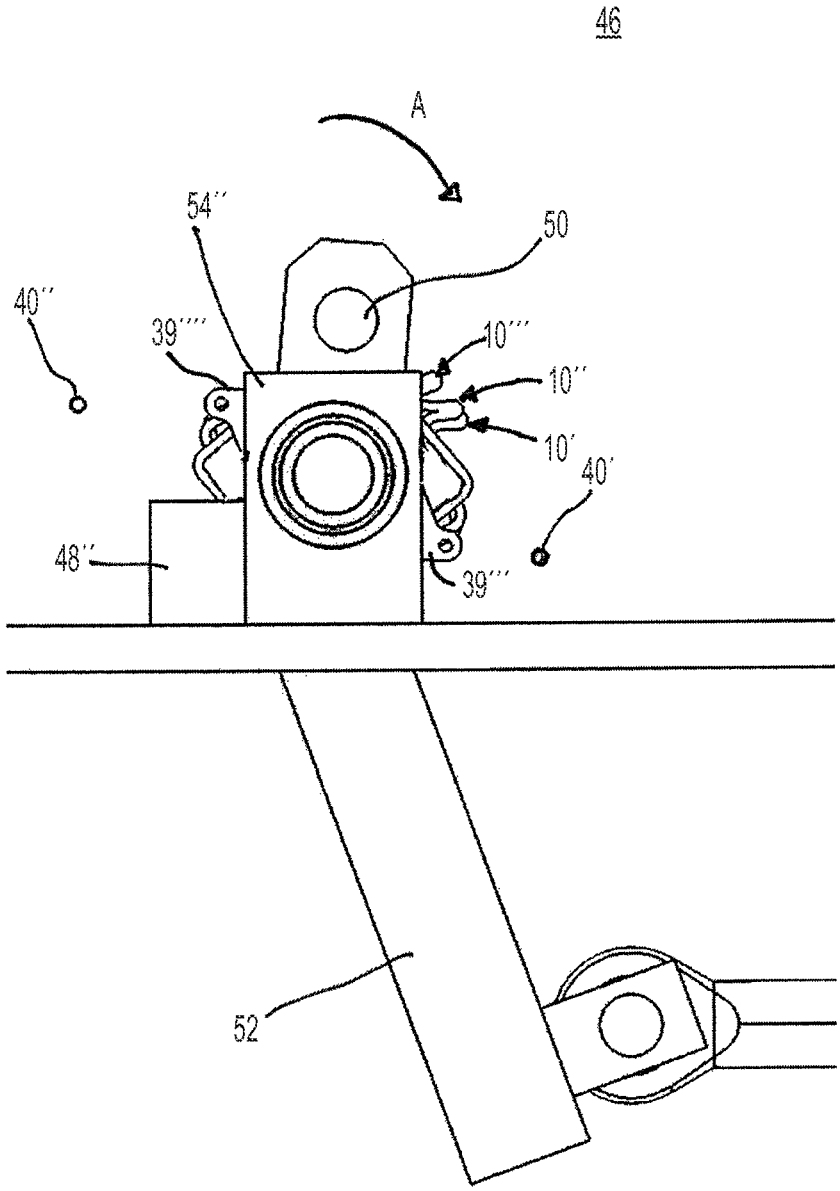

As is particularly clearly shown in FIGS. 10C-10E, in a first stage of deflection of the bar 50 in the direction of the arrow A, a surface region of the bar 50 first engages a region of the external surface of the external casing of a first elastomer torsion-spring element 10''', for example by way of an external-casing cam 18'-18''' formed thereon.

From a second stage of deflection of the bar 50 in the direction of the arrow A a further surface region of the bar 50 engages the external surface of the external casing of a second elastomer torsion-spring element 10''. During the deflection of the bar 50 between the first stage and the second stage, the external surface of the external casing of the first elastomer torsion-spring element 10''', which external surface has previously been engaged, is pivoted or rotated as well. In a third stage of deflection of the bar 50 in the direction of the arrow A, a region of the external surface of the external casing of a third elastomer torsion-spring element 10' is engaged. During the deflection of the bar 50 between the second stage and the third stage the elastomer torsion-spring elements 10''' and 10'' are deflected or rotated. In a fourth stage of deflection of the bar 50 all the elastomer torsion-spring elements 10'-10''' are then deflected or rotated parallel to each other in such a manner that the pins 40', 40'' that are also shown in FIGS. 7A-7C can be inserted through the boreholes of the respective curvatures 39'-39'''' of the individual tensioning elements 38'-38''''. As soon as the pins 40', 40'' have been inserted through the above-mentioned boreholes the above-mentioned deflection of the bar 50 is reversed, i.e. the bar 50 is moved against the direction of the arrow A. The inserted pins 40', 40'' rest against the individual external surfaces of the external casing of the elastomer torsion-spring elements 10'-10''' and are fixed as a result of the effect of the restoring torques of the elastomer torsion-spring elements 10'-10'''. Furthermore, the pins 40', 40'' are in each case held by the tensioning elements 38'-38'''' that are radially coupled in a rotationally rigid manner. Thus the individual elastomer torsion-spring elements 10'-10''' can no longer return to the in each case non-deflected initial state (FIGS. 10A-10E).

FIG. 10E shows the tensioning device 46 in an axial view relative to the tensioning device bearings 54', 54''. This figure shows particularly clearly that the individual elastomer torsion-spring elements 10'-10''' in their initial state in each case are deflected in a different manner. This is due to the fact that the respective internal casings of the elastomer torsion-spring elements 10'-10''' in relation to the contour of their respective external casings are in each case arranged with a rotational offset that differs in each case for each of the elastomer torsion-spring elements 10'-10'''. The rotational offsets of the elastomer torsion-spring elements 10'-10''' can, for example, be 20°, 25° and 40°. Due to the in each case different rotational offset between the internal casing and the external casing the individual elastomer torsion-spring elements 10'-10''' are thus also pre-tensioned to a different extent. In this example the elastomer torsion-spring element 10''' is thus pre-tensioned to a greater extent than is the elastomer torsion-spring element 10'', which in turned is pre-tensioned to a greater extent than is the elastomer torsion-spring element 10'. As indicated in FIGS. 10A and 10C-10E, after pre-tensioning, the pins 40', 40'' can be inserted through the boreholes of the curvatures 39'-39'''' of the respective tensioning elements 38'-38''''. Thus the respective pre-tension of the individual elastomer torsion-spring elements 10'-10''' is maintained by the pins 40', 40''.

It is not possible to select a lesser pre-tension; however, the external casings of the individual elastomer torsion-spring elements 10'-10''' can be rotated further, relative to the corresponding internal casings, in a direction of rotation in such a manner that the restoring torque generated by the respective torsion spring element 10'-10''' increases as the rotation angle increases until the external-casing cams 18'-18''' that have been formed on the respective external casing come to rest against the pin 40'. In this state the elastomer torsion-spring elements 10'-10''' have arrived at their maximum permissible rotation angle, thus in each case providing the greatest possible restoring torque.

The tensioning device 46 shown in FIGS. 10A-10E and the method described in relation to it in an exemplary manner show that the power system 30 described above can be produced very quickly and with only a few manipulations even in the case of differently pre-tensioned elastomer torsion-spring elements 10'-10'''.

While embodiments of the invention have been described herein, it should be understood that it has been presented by way of example only, and not limitation. Thus, the breadth and scope of the invention should not be limited by any of the described embodiments, but should instead be defined only in accordance with the following claims and their equivalents.

The invention claimed is:

1. A seat assembly, comprising:

a seat base;

a back support;

a support for the back support or for the seat base, wherein the back support or the seat base is pivotably hinged to the support to allow a pivoting movement of the back support or of the seat base on a rotation axis; and at least one elastomer torsion-spring element comprising an internal casing, an external casing encompassing the internal casing, and an elastomer body arranged in a space between the internal casing and the external casing, wherein the internal casing comprises at least one contact surface at which the elastomer body is in contact with the internal casing, wherein the external casing comprises at least one contact surface at which the elastomer body is in contact with the external casing, wherein the elastomer body is rigidly connected to the contact surface of the internal casing and to the contact surface of the external casing, wherein the internal casing or the external casing of the at least one elastomer torsion-spring element is rotatably arranged on the rotation axis, wherein the support is coupled to the external casing of the at least one elastomer torsion-spring element, and the back support or the seat base is coupled to the internal casing of the at least one elastomer torsion-spring element, whereby during the respective pivoting movement of the back support or of the seat base, the internal casing rotates by a rotation angle about the rotation axis, during which rotation the internal casing is moved relative to the external casing, whereby deformation of the elastomer body is generated so that the elastomer body generates a restoring torque between the external casing and the internal casing, which restoring torque acts against the rotation, and wherein, in a sectional plane perpendicular to the rotation axis, the contact surface of the internal casing or of the external casing comprises a non-circular cross section.

2. The seat assembly according to claim 1, wherein the external casing of the at least one elastomer torsion-spring element is connected to the support, and the internal casing of the at least one elastomer torsion-spring element is connected to a bearing shaft rotatable about the rotation axis, wherein the bearing shaft is connected in a rotationally rigid manner to the back support or to the seat base.

3. The seat assembly according to claim 1, wherein the contact surface of the internal casing and the contact surface of the external casing are arranged relative to each other so that during rotation of the internal casing or of the external casing about the rotation axis, at least in a predetermined rotary angle range the distance between a defined point of the internal casing and a defined point of the external casing is reduced.

4. The seat assembly according to claim 1, wherein, in the sectional plane perpendicular to the rotation axis, the contact surface of the internal casing and the contact surface of the external casing each comprise a non-circular cross section and are arranged relative to each other whereby rotation of the internal casing or of the external casing on the rotation axis causes a compressive load in at least one region of the elastomer body.

5. The seat assembly according to claim 1, wherein, in the sectional plane perpendicular to the rotation axis, the contact surface of the internal casing or the contact surface of the external casing is polygonal.

6. The seat assembly according to claim 1, wherein, in the sectional plane perpendicular to the rotation axis, the contact surface of the internal casing or the contact surface of the external casing comprises, at least in some sections, straight lines.

7. The seat assembly according to claim 1, wherein the contact surface of the external casing is, at least in some sections, cylindrical.

8. The seat assembly according to claim 1, wherein, in the sectional plane perpendicular to the rotation axis, the contact surface of the external casing is rectangular, and wherein at least two opposite pairs of corners are rounded.

9. The seat assembly according to claim 1, wherein the contact surface of the external casing comprises equilateral angular segments being arranged opposite each other and two semicircular segments being arranged opposite each other, each of the equilateral angular segments having two ends and each of the semicircular segments having two ends, wherein one of the ends of one of the semicircular segments is connected to one of the ends of one of the equilateral angular segments and the other one of the ends of the one of the semicircular segments is connected to one of the ends of the other one of the equilateral angular segments, and wherein one of the ends of the other one of the semicircular segments is connected to the other one of the ends of the one of the equilateral angular segments and the other one of the ends of the other one of the semicircular segments is connected to the other one of the ends of the other one of the equilateral angular segments.

10. The seat assembly according to claim 1, wherein, in the sectional plane perpendicular to the rotation axis, the contact surface of the internal casing is rectangular.

11. The seat assembly according to claim 1, wherein the ratio of a surface area of an internal cross section of the external casing to a surface area of an external cross section of the internal casing is greater than 7/3.

12. The seat assembly according to claim 1, wherein the elastomer body comprises a through-hole in the elastomer body, wherein the respective through-hole extends along the rotation axis.

13. The seat assembly according to claim 1, wherein the at least one elastomer torsion-spring element comprises a retaining element configured to hold the internal casing in a predefined normal position relative to the external casing, wherein when in the normal position the elastomer body comprises a predefined elastic deformation between the external casing and the internal casing and generates a restoring torque that equals a predefined minimum value, and wherein the retaining element is configured to enable rotation of the internal casing relative to the external casing by a rotation angle about the rotation axis in a direction of rotation in which the restoring torque increases as the rotation angle increases.

14. The seat assembly according to claim 13, wherein the retaining element comprises at least one tensioning element comprising a first section that is firmly engaged in the internal casing, and a second section which when the internal casing is in the predefined normal position relative to the external casing comes to rest against a section of the external casing and enables rotation of the internal casing and of the external casing in relation to each other about the rotation axis in the direction of rotation in which the restoring torque increases.

15. The seat assembly according to claim 14, wherein the internal casing comprises a recess, and the first section of the tensioning element is inserted in a rotationally rigid manner into the recess in the internal casing, and the second section of the tensioning element, when the internal casing is in the predefined normal position relative to the external casing, comes to rest against a section of the external casing.

16. The seat assembly according to claim 13, wherein the retaining element comprises at least one tensioning element comprising a first section that is firmly engaged in the external casing, and a second section which when the internal casing is in the predefined normal position relative to the external casing comes to rest against a section of the internal casing and enables rotation of the internal casing and of the external casing in relation to each other about the rotation axis in the direction of rotation in which the restoring torque increases.

17. The seat assembly according to claim 16, wherein the internal casing comprises a recess, and the first section of the tensioning element is inserted in a rotationally rigid manner into the recess in the internal casing, and the second section of the tensioning element, when the internal casing is in the predefined normal position relative to the external casing, comes to rest against a section of the external casing.

18. The seat assembly according to claim 1, further comprising a plurality of the elastomer torsion-spring elements, wherein the elastomer torsion-spring elements are arranged side by side in such a manner that the internal casings or the external casings of the elastomer torsion-spring elements are rotatably arranged on the same rotation axis.

19. The seat assembly according to claim 18, wherein the internal casings of the elastomer torsion-spring elements are rigidly interconnected.

20. The seat assembly according to claim 18, wherein the external casings of the elastomer torsion-spring elements are rigidly interconnected.

21. A seat assembly, comprising:

a seat base;

a back support;

a support for the back support or for the seat base, wherein the back support or the seat base is pivotably hinged to the support to allow a pivoting movement of the back support or of the seat base on a rotation axis; and at least one elastomer torsion-spring element comprising an internal casing, an external casing encompassing the internal casing, and an elastomer body arranged in a space between the internal casing and the external casing, wherein the internal casing comprises at least one contact surface at which the elastomer body is in contact with the internal casing, wherein the external casing comprises at least one contact surface at which the elastomer body is in contact with the external casing, wherein the elastomer body is rigidly connected to the contact surface of the internal casing and to the contact surface of the external casing, wherein the internal casing or the external casing of the at least one elastomer torsion-spring element is rotatably arranged on the rotation axis, wherein the support is coupled to the internal casing of the at least one elastomer torsion-spring element, and the back support or the seat base is coupled to the external casing of the at least one elastomer torsion-spring element, whereby during the respective pivoting movement of the back support or of the seat base, the external casing rotates by a rotation angle about the rotation axis, during which rotation the internal casing is moved relative to the external casing, whereby deformation of the elastomer body is generated so that the elastomer body generates a restoring torque between the external casing and the internal casing, which restoring torque acts against the rotation, and wherein, in a sectional plane perpendicular to the rotation axis, the contact surface of the internal casing or of the external casing comprises a non-circular cross section.

22. The seat assembly according to claim 21, wherein the internal casing of the at least one elastomer torsion-spring element is connected to the support, and the internal casing of the at least one elastomer torsion-spring element is connected to a bearing shaft rotatable about the rotation axis, wherein the bearing shaft is connected in a rotationally rigid manner to the back support or to the seat base.

23. The seat assembly according to claim 21, wherein the contact surface of the internal casing and the contact surface of the external casing are arranged relative to each other so that during rotation of the internal casing or of the external casing about the rotation axis, at least in a predetermined rotary angle range the distance between a defined point of the internal casing and a defined point of the external casing is reduced.

24. The seat assembly according to claim 21, wherein, in the sectional plane perpendicular to the rotation axis, the contact surface of the internal casing and the contact surface of the external casing each comprise a non-circular cross section and are arranged relative to each other whereby rotation of the internal casing or of the external casing on the rotation axis causes a compressive load in at least one region of the elastomer body.

25. The seat assembly according to claim 21, wherein, in the sectional plane perpendicular to the rotation axis, the contact surface of the internal casing or the contact surface of the external casing is polygonal.

26. The seat assembly according to claim 21, wherein, in the sectional plane perpendicular to the rotation axis, the contact surface of the internal casing or the contact surface of the external casing comprises, at least in some sections, straight lines.

27. The seat assembly according to claim 21, wherein the contact surface of the external casing is, at least in some sections, cylindrical.

28. The seat assembly according to claim 21, wherein, in the sectional plane perpendicular to the rotation axis, the contact surface of the external casing is rectangular, and wherein at least two opposite pairs of corners are rounded.

29. The seat assembly according to claim 21, wherein the contact surface of the external casing comprises two equilateral angular segments being arranged opposite each other and two semicircular segments being arranged opposite each other, each of the equilateral angular segments having two ends and each of the semicircular segments having two ends, wherein one of the ends of one of the semicircular segments is connected to one of the ends of one of the equilateral angular segments and the other one of the ends of the one of the semicircular segments is connected to one of the ends of the other one of the equilateral angular segments, and wherein one of the ends of the other one of the semicircular segments is connected to the other one of the ends of the one of the equilateral angular segments and the other one of the ends of the other one of the semicircular segments is connected to the other one of the ends of the other one of the equilateral angular segments.

30. The seat assembly according to claim 21, wherein, in the sectional plane perpendicular to the rotation axis, the contact surface of the internal casing is rectangular.

31. The seat assembly according to claim 21, wherein the ratio of a surface area of an internal cross section of the external casing to a surface area of an external cross section of the internal casing is greater than 7/3.

32. The seat assembly according to claim 21, wherein the elastomer body comprises a through-hole in the elastomer body, wherein the through-hole extends along the rotation axis.

33. The seat assembly according to claim 21, wherein the at least one elastomer torsion-spring element comprises a retaining element configured to hold the internal casing in a predefined normal position relative to the external casing, wherein when in the normal position the elastomer body comprises a predefined elastic deformation between the external casing and the internal casing and generates a restoring torque that equals a predefined minimum value, and wherein the retaining element is configured to enable rotation of the internal casing relative to the external casing by a rotation angle about the rotation axis in a direction of rotation in which the restoring torque increases as the rotation angle increases.

34. The seat assembly according to claim 33, wherein the retaining element comprises at least one tensioning element comprising a first section that is firmly engaged in the internal casing, and a second section which when the internal casing is in the predefined normal position relative to the external casing comes to rest against a section of the external casing and enables rotation of the internal casing and of the external casing in relation to each other about the rotation axis in the direction of rotation in which the restoring torque increases.

35. The seat assembly according to claim 34, wherein the internal casing comprises a recess, and the first section of the tensioning element is inserted in a rotationally rigid manner into the recess in the internal casing, and the second section of the tensioning element, when the internal casing is in the predefined normal position relative to the external casing, comes to rest against a section of the external casing.

36. The seat assembly according to claim 33, wherein the retaining element comprises at least one tensioning element comprising a first section that is firmly engaged in the external casing, and a second section which when the internal casing is in the predefined normal position relative to the external casing comes to rest against a section of the internal casing and enables rotation of the internal casing and of the external casing in relation to each other about the rotation axis in the direction of rotation in which the restoring torque increases.

37. The seat assembly according to claim 36, wherein the internal casing comprises a recess, and the first section of the tensioning element is inserted in a rotationally rigid manner into the recess in the internal casing, and the second section of the tensioning element, when the internal casing is in the predefined normal position relative to the external casing, comes to rest against a section of the external casing.

38. The seat assembly according to claim 21, further comprising a plurality of the elastomer torsion-spring elements, wherein the elastomer torsion-spring elements are arranged side by side in such a manner that the internal casings or the external casings of the respective elastomer torsion-spring elements are rotatably arranged on the same rotation axis.

39. The seat assembly according to claim 38, wherein the internal casings of the elastomer torsion-spring elements are rigidly interconnected.

40. The seat assembly according to claim 38, wherein the external casings of the elastomer torsion-spring elements are rigidly interconnected.

* * * * *